US009182202B2

(12) United States Patent
Menefee, III

(10) Patent No.: US 9,182,202 B2
(45) Date of Patent: Nov. 10, 2015

(54) PAYLOAD DELIVERY SYSTEM WITH PLEATED COMPONENT FOR CARTRIDGES

(76) Inventor: James Y. Menefee, III, Macon, GA (US)

( * ) Notice: Subject to any disclaimer, the term of this patent is extended or adjusted under 35 U.S.C. 154(b) by 0 days.

(21) Appl. No.: 13/599,818

(22) Filed: Aug. 30, 2012

(65) Prior Publication Data

US 2013/0055917 A1 Mar. 7, 2013

Related U.S. Application Data

(60) Provisional application No. 61/530,101, filed on Sep. 1, 2011.

(51) Int. Cl.

| | |
|---|---|
| ***F42B 7/08*** | (2006.01) |
| ***F42B 7/04*** | (2006.01) |
| ***F42B 7/10*** | (2006.01) |
| ***F42B 5/02*** | (2006.01) |
| ***F42B 5/145*** | (2006.01) |
| ***F42B 8/02*** | (2006.01) |
| ***F42B 14/00*** | (2006.01) |

(52) U.S. Cl.

CPC ... *F42B 7/08* (2013.01); *F42B 7/04* (2013.01); *F42B 7/10* (2013.01); *F42B 5/02* (2013.01); *F42B 5/145* (2013.01); *F42B 8/02* (2013.01); *F42B 14/00* (2013.01)

(58) Field of Classification Search

CPC ..... F42B 5/00; F42B 5/02; F42B 5/145; F42B 7/00; F42B 7/02; F42B 7/04; F42B 7/043; F42B 7/08; F42B 7/10; F42B 8/00; F42B 8/02; F42B 14/00

USPC ..... 102/448, 449, 450, 451, 453, 457, 460, 102/461, 452, 454, 455, 456, 520, 521, 522, 102/523

See application file for complete search history.

(56) References Cited

U.S. PATENT DOCUMENTS

| | | | | | |
|---|---|---|---|---|---|
| 1,297,216 | A | * | 3/1919 | Matteus | 102/449 |
| 2,125,224 | A | * | 7/1938 | Edwards | 102/449 |
| 2,953,990 | A | * | 9/1960 | Miller | 102/449 |
| 3,074,344 | A | | 1/1963 | Pierre | |
| 3,313,235 | A | * | 4/1967 | Middleton, Jr. | 102/449 |
| 4,295,426 | A | * | 10/1981 | Genco et al. | 102/451 |
| 4,733,613 | A | | 3/1988 | Bilsbury et al. | |
| 4,773,329 | A | * | 9/1988 | Bilsbury | 102/451 |
| 5,874,689 | A | * | 2/1999 | Alkhatib et al. | 102/453 |
| 7,415,929 | B1 | | 8/2008 | Faughn | |
| 8,555,785 | B2 | * | 10/2013 | Cross | 102/451 |
| 2005/0039627 | A1 | * | 2/2005 | Zanoletti | 102/449 |

FOREIGN PATENT DOCUMENTS

| | | | |
|---|---|---|---|
| FR | 1548296 | A | 12/1958 |
| FR | 1180220 | A | 6/1959 |

OTHER PUBLICATIONS

International Search Report and Written Opinion for PCT/US2012/053060 mailed Nov. 23, 2012.

* cited by examiner

*Primary Examiner* — James S Bergin

(74) *Attorney, Agent, or Firm* — Sutherland Asbill & Brennan LLP

(57) ABSTRACT

This disclosure provides for payload delivery systems and cartridges and methods that incorporate these payload delivery systems. In one aspect, the payload delivery system can comprise a payload cup and a pleated cup nested within the payload cup and having a pleated side wall. The disclosed cartridges can be used to deliver payloads such as solid projectiles, shot of all sizes, powders, gels, liquids, and other payloads to exploit their specific function.

19 Claims, 8 Drawing Sheets

PAYLOAD DELIVERY SYSTEM WITH PLEATED COMPONENT FOR CARTRIDGES

CROSS REFERENCE TO RELATED APPLICATIONS

This application claims the benefit of U.S. Provisional Application No. 61/530,101, filed Sep. 1, 2011, the disclosure of which is incorporated herein by reference in its entirety.

TECHNICAL FIELD OF THE INVENTION

This disclosure relates to cartridges for launching a payload and the cartridge components themselves, including cartridges and components for launching a payload comprising solid projectiles, liquid- or gel-containing projectiles, or powders.

BACKGROUND

Cartridge systems constitute extremely practical constructions and methods for deploying almost any payload or projectile downrange. Typical cartridge systems incorporate the desired payload, a propellant, and some priming composition all within a self-contained unit. While ammunition cartridges are prototypical of cartridge devices, cartridge systems have been used to launch chemical, pyrotechnic, marker, tracer, signaling, non-lethal, explosive, smoke, and other payloads to exploit their specific function. These more complex payloads often require additional complex and expensive components beyond the nominal propellant, projectile, and primer for their effective use in cartridges.

Shotshell cartridges are also complex cartridge systems because shotshells require intricate components beyond those necessary in rifle or pistol rounds. Many of the principles of payload delivery systems developed in shotshell cartridges are applicable to launching chemical, pyrotechnic, signaling, non-lethal, and other complex payloads in their respective cartridges. For example, a shotshell "wad" is the general term applied to the collection of components in a shotshell other than the projectile(s), the propellant, and the primer, which is used for effective delivery of the projectiles. Shotshell wads may be designed for various functions such as providing a seal against expanding propellant gases, containing and stabilizing the projectile(s) for a desired distance downrange, and/or cushioning and barrel protection. Components having similar functions are often required to launch chemical, pyrotechnic, non-lethal, and other complex payloads in a cartridge. In all these cases, the expense and complexity of construction, tooling, and manufacture of these components and the cartridges themselves can be challenging.

Therefore, there exists a need for new cartridge components and structures for the more complex cartridge systems—that is, beyond the projectile, propellant, and primer—that do not require new specialty tooling with its associated high capital costs. There is also a need for cartridge components and cartridges that can be readily adapted for delivering virtually any complex and difficult-to-handle payload downrange, such as powders, liquids, and gels, as well as solids. Such components would be versatile enough to be used in shotshells, but also for launching chemical, pyrotechnic, non-lethal, non-lethal, explosive, and other similarly complex payloads. Desirably, these components would generally avoid the complicated features that can prohibitively increase costs.

SUMMARY OF THE INVENTION

The present disclosure relates to cartridges for delivering payloads, the payload delivering component of the cartridges, and the associated methods of making and using the components and cartridges. Typically, this disclosure uses shotshells as exemplary "complex" cartridge systems and the disclosed components may be discussed in terms of their shotshell applications or aspects. However, the principles of payload delivery systems described herein are applicable to launching chemical, pyrotechnic, signaling, non-lethal, and other complex payloads in their respective cartridges. Indeed, it is to be understood that this disclosure and the appended claims are not limited to shotshells, because the disclosed structures, components, and methods have a wide utility and are adaptable to the delivery of any number of payload types downrange.

One aspect of this disclosure relates to a payload delivery system that includes, as its fundamental element, at least one pleated cup. In various embodiments, the pleated cup can be used as a stabilizing component, or simply "stabilizer", when it is attached to another component in the cartridge. For example, the pleated cup can be or can comprise a stabilizing component which assists in stabilizing the payload during flight to any extent desired. In this aspect, the pleated cup can be attached to another component such as a projectile container or "cup" or attached directly to at least a portion of the payload itself, such as a projectile, and thereby function as a means to impart high stability and drag to that other component, payload, or projectile. In other various embodiments, the pleated cup itself can be used as a means to embrace the payload, and therefore serve as a "pleated payload cup", until a point in time or distance after launching at which the pleated cup separates from the payload and delivers it in free flight. By way of example, in this configuration of containing the payload, the pleated cup can assist in launching powders, gels, liquids, capsules containing powders, gels, or liquids, other solids, even other payloads such as solid projectiles, to exploit their specific function.

Specifically, in its pre-launched configuration, the pleated component of this disclosure can be a pleated cup with a forward-facing open end, having a pleated side wall that defines a cavity. The cavity can contain either the payload itself, or the cavity can contain a payload cup or container in which the payload cup or container contains the payload. For example, when the pleated cup is attached to the payload cup, it may be referred to as a stabilizing component or stabilizer, because it functions to impart stability and different degrees of drag to the payload cup during flight, for a desired ballistic performance. The combined and attached pleated cup and payload cup, which may be referred to as a "stabilized payload cup", can provide for early or late release of the payload as desired, because stability is achieved by the function of the pleated cup. Additional structures and functions can be incorporated into a stabilized payload cup, such as a means to puncture or rupture a capsule that houses a gel or liquid payload contained within the stabilized payload cup. In one aspect, the pleated side wall of the pleated cup allows the folding and gathering of additional area of pleated cup material into a more compact shape, which permits its use in a cartridge.

When constructed of suitable materials, the pleated cup of this disclosure can contain the payload in its own cavity. In this aspect, the pleated cup function as its own type of pleated payload container or pleated payload cup, rather than functioning as a stabilizer, to achieve the desired performance with certain payloads, such as powders. For example, a pleated cup can impart a sabot effect on a projectile that it contains and be used to fire a projectile that is sub-bore diameter and to hold that projectile in a more precise position throughout launching. Also by way of example, using the pleated cup to contain and launch the payload itself can be useful for imposing a sudden charge of powder or liquid into a confined space, such as might be required in chemical, biological, or other encounters.

Typically, the stabilized payload cup or the pleated cup itself can be used in conjunction with an obturating component to provide a seal against expanding propellant gases. This disclosure provides for use of virtually any obturating component, including pre-formed gas seals of any type or an obturating medium. When using a pre-formed gas seal, the pre-formed gas seal can be loaded into the cartridge as a separate component, or it can be attached in any manner to the stabilized payload cup or the pleated payload cup itself and used as the combination in a cartridge.

Accordingly, the present disclosure generally relates to cartridges for delivering payloads, the payload delivering components of cartridges, and the associated methods of making and using the components and cartridges. Among other things, this disclosure provides for a payload delivery system comprising, in its pre-launched configuration:

a) a payload cup having an open fore end, a closed aft end, and a cylindrical side wall defining a cavity;

b) a pleated cup coaxially aligned with the payload cup, having an open fore end, a closed aft end, and a pleated side wall defining a cavity that terminates at an edge contiguous with the open fore end, wherein the payload cup is nested within the pleated cup, such that the payload cup aft end is adjacent and attached to the pleated cup aft end.

In this aspect, the pleated cup is attached to the payload cup to ensure stability and provide drag for a clean separation of the payload cup from the payload. The payload cup aft end and the pleated cup aft end can be connected or attached by any means, without limitation, and attachment does not require a connector component. For example, when made of the appropriate materials, the payload cup and the pleated cup can be attached by a melting process, by a punching method, by a sonic weld process, and the like. In various embodiments, the payload cup and the pleated cup can be attached by a connector component. For example, the connector can be selected from a rivet, a screw, a staple, a pin, a bolt, a brad, an anchor, an adhesive, a tack, or a nail, or in certain embodiments, multiple connectors, or any combination of these connectors.

The pleated cup also not limited as to the material from which it is fabricated. For example, in some aspects, the pleated can be made of any type of paper, plastic, polymer-coated paper, fabric, and more, depending on the particular payload and/or cartridge and the properties desired for the pleated cup with respect to its function.

Similarly, the payload cup also is not limited to a particular material, and the material is selected for its properties of thickness, strength, ease of fabrication, and so forth. For example, in some aspects, the pleated can be made of any type of paper, polymer or plastic, polymer-coated paper, and the like, depending on the particular payload and cartridge and the intended launching parameters such as velocity that are needed. In some embodiments, the closed aft end of the payload cup can be crimped closed, which simplifies the construction and lowers the cost of the payload delivery system. This payload delivery system can further comprise a pre-formed gas seal attached thereto or used a pre-formed gas seal as a separate element, or this payload delivery system can employ so-called "wadless" technology which does not require a pre-formed gas seal of any type.

In a further aspect, this disclosure provides for a cartridge comprising a payload delivery system as disclosed herein, wherein the cartridge is an ammunition cartridge, a flare cartridge, a smoke flare cartridge, a signaling device cartridge, a chemical cartridge, a distraction device cartridge, a pyrotechnic launching device cartridge, a marking cartridge, a grenade launcher cartridge, an incendiary cartridge, an explosive cartridge, a tracer cartridge, an armor-piercing cartridge, or a non-lethal cartridge.

In a further aspect, this disclosure provides for a payload delivery system that comprises, in its pre-launched configuration:

a) a pleated cup having an open fore end, a closed aft end, and a pleated side wall defining a cavity;

b) an obturating component adjacent the payload cup aft end, comprising for example a pre-formed gas seal coaxially aligned with the payload cup or an obturating medium; and c) at least one payload contained within the cavity of the payload cup.

In this aspect, the pleated cup typically is used as a means to contain, support, or contain the payload until a point in time or distance after launching the pleated cup separates from the payload and delivers it in free flight. In this configuration of containing the payload itself, the pleated cup can assist in launching powders, gels, liquids, capsules containing powders, gels, or liquids, other solids, even other payloads such as solid projectiles, to exploit their specific function. Therefore, this construction can be adjusted across a range of applications for launching a number of payloads.

There is further provided a payload delivery system comprising, in its pre-launched configuration, a pleated cup having an open fore end, a closed aft end, and a pleated side wall defining a cavity. Accordingly, this disclosure further provides a method of loading a cartridge comprising charging a cartridge case with a pleated cup having an open fore end, a closed aft end, and a pleated side wall defining a cavity. This novel aspect can include embodiments in wherein the pleated side wall is in contact with the inner wall of the cartridge case. Various embodiments of this method can further comprise charging the cartridge case with an obturating component adjacent the pleated cup aft end.

While this disclosure is applicable to the construction of shotshells, flare cartridges, chemical cartridges, signal cartridges, non-lethal cartridges and the like, it is not necessary to fire these cartridges from a firearm or a device that includes a muzzle. To the contrary, certain cartridges such as flare or chemical cartridges that include the disclosed components can further incorporate a system for self-firing or self-activation of the cartridge without a separate firing device like a flare gun. Optionally, such cartridges with the firing component or trigger device built in can be protected from accidental firing by a pin or other type of firing safety.

Another aspect of this disclosure is provided in the operation of the payload delivery system upon being launched from the cartridge, particularly the function of the pleated cup. The pleated cup is a cup-shaped component having a pleated side wall, which has its open end forward-facing, whether used in combination with a separate payload cup to which it is attached or whether used in the absence of a separate payload cup. When attached to a separate payload cup, the pleated cup is generally coaxially aligned with the payload cup, and the payload cup is nested within the pleated cup to which it is attached. In this configuration, the open ends of both the pleated cup and the payload cup are directed forward, in a downrange fashion. Upon launching, the entire payload delivery system comprising the payload cup, pleated cup, and the selected payload, is discharged from the cartridge along with the selected payload. After a certain distance in flight, the pleated cup opens and inverts, much like an umbrella will invert from a gust of wind. Inversion is made possible by the additional area of material contained within the pleated side wall, and the trailing material imparts both high drag and high stability to the cartridge payload delivery system in this manner.

When the pleated cup is used in the absence of a payload cup, the pleated cup may be referred to as a simply "pleated payload cup". The open end of the pleated payload cup is directed forward and is launched from a cartridge with its payload. After a certain distance in flight, the forward end of the pleated payload cup opens and cleanly separates from the payload. This embodiment and aspect can be particularly useful when a payload of chemical or powder is to be deployed a short ranges. Moreover, in such embodiments, the pleated payload cup provide a sabot effect to precisely center a sub-bore diameter projectile. Whether the pleated payload cup inverts or does not invert is not relevant, because the drag function is not imparted from the pleated payload cup to the payload. This manner of using a pleated component contrasts to the system in which a pleated cup is one component and a projectile cup is separate component, and they are attached in a manner that a stability and drag function is imparted to the payload cup.

This disclosure further provides for a cartridge comprising a payload delivery system as described herein. If desired, the cartridge can comprise a conventional pre-formed gas seal in combination with the disclosed payload delivery system, or the cartridge can utilize the disclosed payload delivery system with an obturating medium that is not pre-formed into a gas seal. This latter, wadless technology provides an extremely versatile system to launch a range of projectiles downrange. In this aspect, for example, a cartridge according to this disclosure can comprise:

a) a cartridge case having a fore end and an aft end and, comprising a primer situated at the aft end;
b) a propellant adjacent the primer;
c) an obturating medium adjacent the propellant;
d) a payload delivery system adjacent the obturating medium comprising a pleated cup and optionally further comprising a payload cup, and
e) a payload at least partially contained within the cavity of the pleated cup or the payload cup;

wherein the cartridge does not contain a pre-shaped gas seal.

In a further aspect to the above-disclosed cartridge, the obturating medium can be used in combination with a pre-formed gas seal or alternatively, can be replaced by a pre-formed gas seal if desired. By way of example, the cartridge payload delivery system can be used with an obturating medium such as a granular polyethylene, polypropylene, or a combination thereof.

The fundamental aspects of the payload delivery system, that is, the payload cup, the pleated cup, and their embodiments, configurations, and other aspects disclosed herein, are applicable to launching payloads in any manner known. Thus, while the payload delivery system and payload can be discharged using cartridges, the system and payload also can be launched using compressed gases such as in a $CO_2$ or air gun, or in a pressure device that uses a liquid as a reactive mass.

When taken in conjunction with the accompanying drawings, detailed description, and the appended claims, the various features of this disclosure become apparent. Supporting aspects of this disclosure are found, for example, in the following publications and patents, each of which is incorporated herein by reference in its entirety: Thomas J. Griffin, editor, *Shotshell Reloading Handbook,* 5$^{th}$ ed., Lyman Publications, Lyman Products Corporation, Middletown, Conn., c. 2007; Don Zutz, *Hodgdon Powder Company Shotshell Data Manual,* 1$^{st}$ ed., Hodgden Power Company, Shawnee Mission, Kans., c. 1996; Bob Brister, *Shotgunning: The Art and the Science*, Winchester Press, New Win Publishing, Inc., Clinton, N.J., c. 1976; and U.S. Patent Application Publication Number 2011/0017090. Even though each of these incorporated references concern shotshells and their components, shotshells are used herein as exemplary cartridge systems and the disclosed components, methods, and principles are applicable to launching any type of payload in a cartridge system. The disclosure and the appended claims are not limited to shotshells, because the disclosed structures, components, and methods have a wide utility and are adaptable to any number of payload delivery systems.

BRIEF DESCRIPTION OF THE DRAWINGS

Various aspects and embodiments of this disclosure are illustrated in the drawings in which like reference characters designate the same or similar parts throughout the figures.

DETAILED DESCRIPTION OF THE INVENTION

This disclosure provides for a payload delivery system for use in cartridges or launched in any fashion, the system including a pleated cup that assists in the discharge, launching, and ballistic performance of the payload. In some aspects, the pleated cup can serve as a flight stabilizer for any payload or payload cup to which it is attached. If desired and in some embodiments, other components such as spacers can be used along with the projectiles and the pleated cup. The pleated cup can be adjusted to achieve different degrees of drag for a desired ballistic performance. In other aspects, the pleated cup can contain the payload in its own cavity and function as its own type of payload container or payload cup. In this aspect, after a certain distance downrange, the pleated cup can open and peel back to cleanly separate from its payload. The potential advantages of this payload delivery system include using relatively low-cost components, avoiding complicated structures, generally eliminating the high capital cost of new tooling, and affording an ease of manufacturing.

Portions of this disclosure discuss shotshells as exemplary cartridge systems that can use the disclosed components, and these components may be discussed in terms of their shotshell applications. However, this disclosure relates to virtually any type of launching system such as a cartridge system and components of such launching systems and cartridge systems for delivering any number of payload types. For example, the components and methods disclosed here are equally amenable to constructing shotshell cartridges which launch their payload at high velocities, as they are to constructing cartridges for launching liquid, powder or gel payloads at low velocities. Thus, the disclosed payload delivery systems are applicable to chemical, pyrotechnic, signaling, non-lethal, and other complex cartridge systems, as well as shotshells with bird shot, buck shot, or slug projectiles. Accordingly, the disclosure and the claims are not limited to any particular type of cartridge delivery system.

General Structure of the Payload Delivery System

In one aspect, there is provided a payload delivery system comprising, in its pre-launched configuration:

a) a payload cup having an open fore end, a closed aft end, and a cylindrical side wall defining a cavity;

b) a pleated cup coaxially aligned with the payload cup, having an open fore end, a closed aft end, and a pleated side wall defining a cavity that terminates at an edge contiguous with the open fore end, wherein the payload cup is nested within the pleated cup, such that the payload cup aft end is adjacent and attached to the pleated cup aft end; and c) optionally, a connector element that unites the payload cup and the pleated cup.

Representative embodiments illustrated in the figures are generally shown with a connector element to unite the payload cup and the pleated cup.

Figure 1:
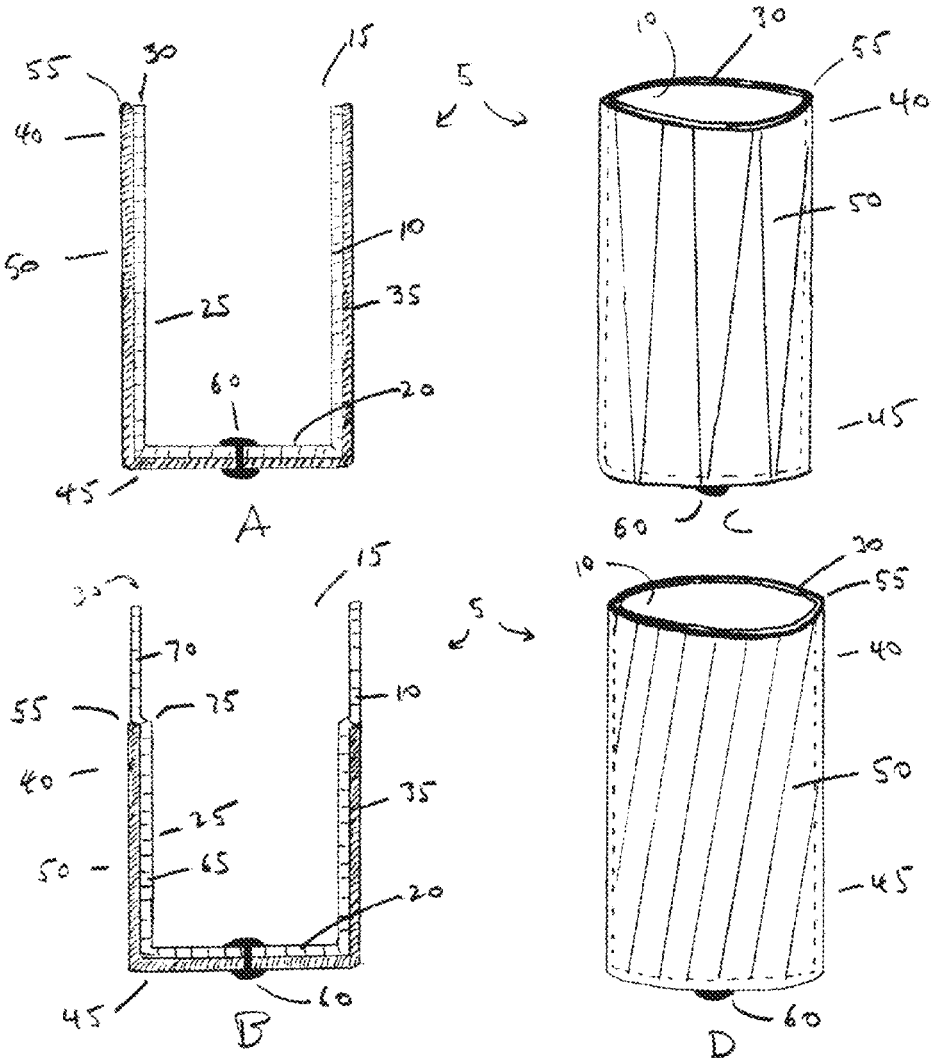
FIG. 1A illustrates a sectional view of a representative embodiment of a payload delivery system in its pre-launched configuration showing the payload cup, the pleated cup, and in this embodiment a connector, as provided by this disclosure.
FIG. 1B illustrates a sectional view of a representative embodiment of a payload delivery system in its pre-launched configuration showing the payload cup, the pleated cup, and in this embodiment a connector, as provided by this disclosure, highlighting a recessed aft portion of the payload cup.
FIG. 1C illustrates a perspective view of a representative embodiment of a payload delivery system in its pre-launched configuration showing the pleated cup that surrounds the payload cup, highlighting the box pleats of the pleated cup.
FIG. 1D illustrates a perspective view of a representative embodiment of a payload delivery system in its pre-launched configuration showing the pleated cup that surrounds the payload cup, highlighting the knife pleats of the pleated cup.
Figure 1A:
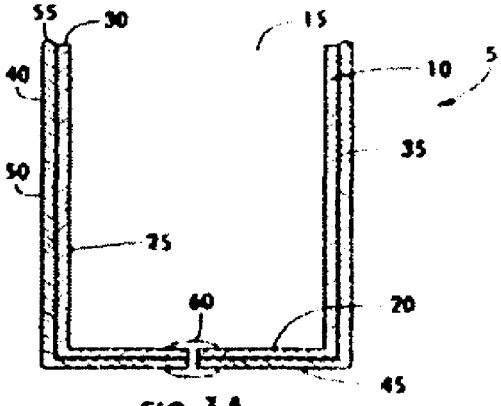

FIG. 1A illustrates a sectional view of a representative embodiment of a payload delivery system 5 in its pre-launched configuration, the payload delivery system including a payload cup 10 and a pleated cup 35. Payload cup 10 has an open forward or fore end 15, a closed rearward or aft end 20, and a cylindrical side wall 25 defining a cavity that terminates at a rim 30 contiguous with the open fore end 15. The pleated cup 35 is coaxially aligned with the payload cup 10 and has an open forward or fore end 40, a closed rearward or aft end 45, and a pleated side wall 50 defining a cavity that terminates at an edge 55 contiguous with the open fore end 40. As illustrated, the payload cup rearward end 20 is located within the pleated cup cavity and adjacent the pleated cup rearward end 45, such that the payload cup is nested within the pleated cup. That is, the bottom of the payload cup 10 generally sits within and at the bottom of the pleated cup 35.

In FIG. 1A, a connector 60 joins or unites payload cup 10 and pleated cup 35 such that the bottoms of these components are maintained in this contiguous and adjacent situation after launch, and are not separated during flight. In this manner, the pleated cup imparts its stabilizing and drag effect as it unfolds and inverts during flight. While a simple rivet type connector 60 is illustrated in FIGS. 1A-D, the payload delivery system of this disclosure is not so limited, as the connector can be selected from or alternatively can comprise a rivet, a screw, a staple, a pin, a bolt, an anchor, an adhesive, a tack, or a nail, or any similar structure that can unite the payload cup 10 and pleated cup 35. However, the payload cup aft end and the pleated cup aft end can be connected or attached by any means, and attachment does not require a connector component. For example, the payload cup and the pleated cup could be attached by a melting process, by a punching method, by a sonic weld process, and the like. Moreover, additional structures and functions can be incorporated into the connector 60, such as a point or edge that is exposed to the inside of the payload cup at the aft end, that provides a means to puncture or rupture a capsule that houses a gel or liquid payload contained within the stabilized payload cup.

Figure 1B:
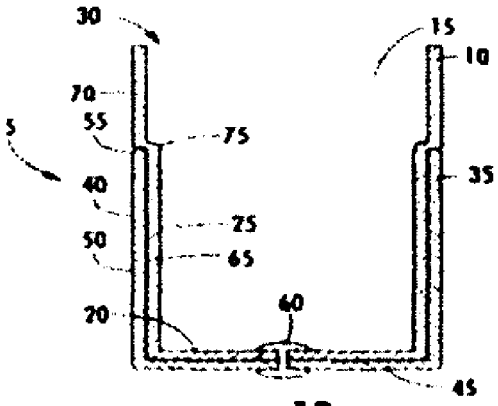

FIG. 1B illustrates a sectional view of another representative embodiment of a payload delivery system 5 in its pre-launched configuration, showing the payload cup 10, the pleated cup 35, and in this embodiment a connector 60. In this embodiment, the payload cup 10 has a recessed aft portion 65, a non-recessed forward portion 70, and an annular step 75 that forms the transition between the two portions. The recessed aft portion 65 has a smaller diameter than forward portion 70, and the forward portion can generally remain in contact with the inner wall of the cartridge when loaded. In some embodiments, the pleated cup 35 can fit around the recessed aft portion 65 of the payload cup, such that the forward portion 70 of payload cup has approximately the same outer diameter as the pleated cup 35 when it is installed about the recessed aft portion 65. The embodiment shown in FIG. 1B shows the pleated cup edge 55 situated flush against the annular step 75, which maintains the approximately same outer diameter in the forward 70 portion as in the recessed aft 65 portions with the pleated side wall 50 installed. In this typical embodiment, the pleated cup side wall 50 is approximately the same length as the recessed aft portion 65 side wall, although other embodiments provide that the pleated cup side wall 50 can be longer or shorter than the aft portion 65 side wall. A connector 60 of any type can be employed to join the payload cup 10 and pleated cup 35, or as disclosed herein, the payload cup and pleated cup can be joined without a discrete connector element.

Figure 1C:
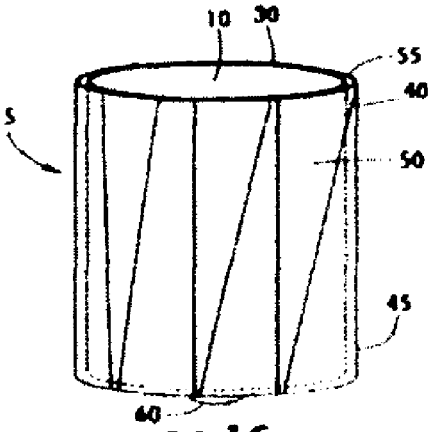
Figure 1D:
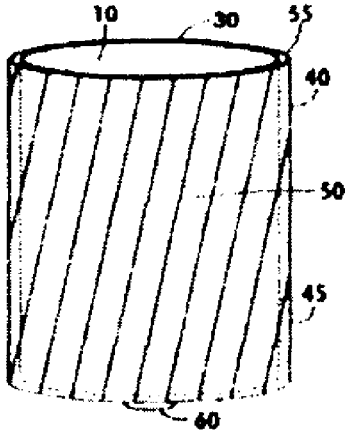

FIGS. 1C and 1D illustrate perspective views of representative embodiments of a payload delivery system in its pre-launched configuration 5, showing the pleated cup 35 and the relative arrangement of the payload cup 10 and pleated cup 35 components. The embodiment shown in FIG. 1C illustrates the pleated cup having box pleats, which surrounds the payload cup. The embodiment shown in FIG. 1D illustrates the pleated cup having knife pleats, which surrounds the payload cup. The pleated cup fore end 40, aft end 45, pleated cylindrical side wall 50, and pleated cup edge 55 are seen in perspective.

In one aspect, and while not limiting, the pleated side wall of the pleated cup can extend any portion of the length of the cylindrical side wall of the payload cup and in some embodiments, can extend greater than the length of the cylindrical side wall of the payload cup. Some embodiments include a pleated cup side wall that generally extend the entire length of the cylindrical side wall of the payload cup. The use of these substantially full-length pleated cup side walls generally allows the use of thinner payload cups than typically would be required if no double-layer of pleated cup material and payload cup material are used. A construction in which the pleated cup side wall and the payload cup overlap in their pre-launched configuration provides the temporary lamination effect of the pleated cup and the payload cup for strength and allows relatively thin materials to be used for the pleated cup and payload cup.

By way of example, the pleated side wall of the pleated cup can extend about or greater than 10% the length of the cylindrical side wall of the payload cup; alternatively, about or greater than 15%; alternatively, about or greater than 20%; alternatively, about or greater than 25%; alternatively, about or greater than 30%; alternatively, about or greater than 35%; alternatively, about or greater than 40%; alternatively, about or greater than 45%; alternatively, about or greater than 50%; alternatively, about or greater than 55%; alternatively, about or greater than 60%; alternatively, about or greater than 65%; alternatively, about or greater than 70%; alternatively, about or greater than 75%; alternatively, about or greater than 80%; alternatively, about or greater than 85%; alternatively, about or greater than 90%; alternatively, about or greater than 95%; alternatively, about or greater than 100%; alternatively, about or greater than 105%; or alternatively, about or greater than 110% the length of the cylindrical side wall of the payload cup. In some embodiments, the pleated side wall of the pleated cup can extend at least 85% the length of the cylindrical side wall of the payload cup. In another aspect, the pleated side wall of the pleated cup can extend at least 90%, at least 95%, or about 100%, the length of the cylindrical side wall of the payload cup. In further embodiments, the pleated side wall of the pleated cup can extend greater than 100% the length of the cylindrical side wall of the payload cup if it is desired to provide additional material forward of the aft portion of the payload cup that can be folded over the open fore end of the payload cup.

FIGS. 1C and 1D illustrates another aspect of this disclosure, namely that the payload cup 10 is not required to have slits in its cylindrical side wall for the wad structure to function. Slits must be either molded or cut into conventional payload cups and the consistent molding or cutting of slits in conventional cups can be difficult. Therefore, the present payload delivery system that does not require slits affords improvements in ease of manufacturing and costs as compared to conventional wad structures. Slits are not required in the present payload delivery system, because the drag that results from the petals of a conventional slit payload cup opening up is provided by the pleated cup, which unfolds and inverts during flight. Moreover, the absence of slits in the present payload delivery system provides better barrel protection when used in shotshells, particularly for hard shot such as steel, because there are no cut or weakened areas that can allow pellets to work through as they are accelerated down the barrel, and make contact with barrel and/or choke. While the disclosed payload delivery system does not require slits in the payload cup to function, the payload cup can incorporate slits, cut-outs, perforations, and the like, if so desired. In this case, structures such as perforations can impart a greater stabilizing function on the pleated cup as it opens and inverts.

In accordance with one further aspect of this disclosure, there is provided a payload delivery system comprising, in its pre-launched configuration:

a) a payload cup having an open fore end, a closed aft end, and a cylindrical side wall defining a cavity;

b) a pleated cup coaxially aligned with the payload cup, having an open fore end, a closed aft end, and a pleated side wall defining a cavity that terminates at an edge contiguous with the open fore end, wherein the payload cup is nested within the pleated cup, such that the payload cup aft end is adjacent and attached to the pleated cup aft end; and c) optionally, a connector that unites the payload cup and the pleated cup;

further comprising:

d) an obturating component adjacent the aft end of the pleated cup, comprising a pre-formed gas seal or an obturating medium.

In this aspect, the payload delivery system can further comprise: d) a pre-formed gas seal adjacent the aft end of the pleated cup and coaxially aligned with the payload cup and the pleated cup, wherein the connector further unites the gas seal with the payload cup and the pleated cup. In this manner, the pleated cup unfolds and inverts over the pre-formed gas seal as the entire delivery system including the gas seal component is launched downrange. In other aspects, it is not necessary to attach the pre-formed gas seal adjacent the aft end of the pleated cup to the combined pleated cup and payload cup.

In another aspect, and in contrast to including a pre-formed gas seal, the payload delivery system can further comprise: d) an obturating medium adjacent the aft end of the pleated cup. This so-called "wadless" technology, which does not employ a pre-formed gas seal, is further described herein.

Pleated Cup Structure

An aspect of this disclosure is provided in the structure and composition of the pleated cup. For example, in one aspect, the pleated cup can be made of, or alternatively can comprise, paper, at least one polymer, or fabric. In its pre-launched configuration, the pleated cup is reminiscent of a paper condiment cup having an open top, a closed bottom, and a pleated side wall that can be cylindrical to slightly frustoconical. The pleated sidewall 50 in the pre-launched pleated cup 35 allows the pleated cup to unfold and invert in a controlled and symmetric fashion during flight, such that the payload delivery system as a whole can be decelerated in a highly stable manner. The pleated cup side wall 50 can assume any pleated structure such that the material itself is folded in a fashion to expose less surface area than it does in its unfolded form. For example, the pleated side wall 50 can comprise knife pleats, box pleats, accordion pleats, cartridge pleats, fluted pleats, Fortuny pleats, honeycomb pleats, organ pleats, Plissé pleats, rolled pleats, or Watteau pleats. In one aspect, accordion pleats and some others can provide a cushioning effect for the payload upon firing, similar to the collapsible legs of a plastic wad used in shotshells.

The use of a pleated cup to function as a stabilizer or as a pleated payload cup affords certain advantages in manufacturing the disclosed cartridges. For example and while not intending to be limiting, the pleated component can be manufactured from flat sheets of suitable materials. The desired shape of the material to be pleated can be die cut or punched from flat sheets and subsequently pleated into the appropriate shape using established technology. The manufacturing advantages of using flat sheets include the relative low cost of flat sheet materials as compared to other forms. Further, using flat sheets avoids the limitations of injection molding in terms of high cost, restrictions in compositions suitable for molding, and initial capital costs for tooling.

Figure 2:
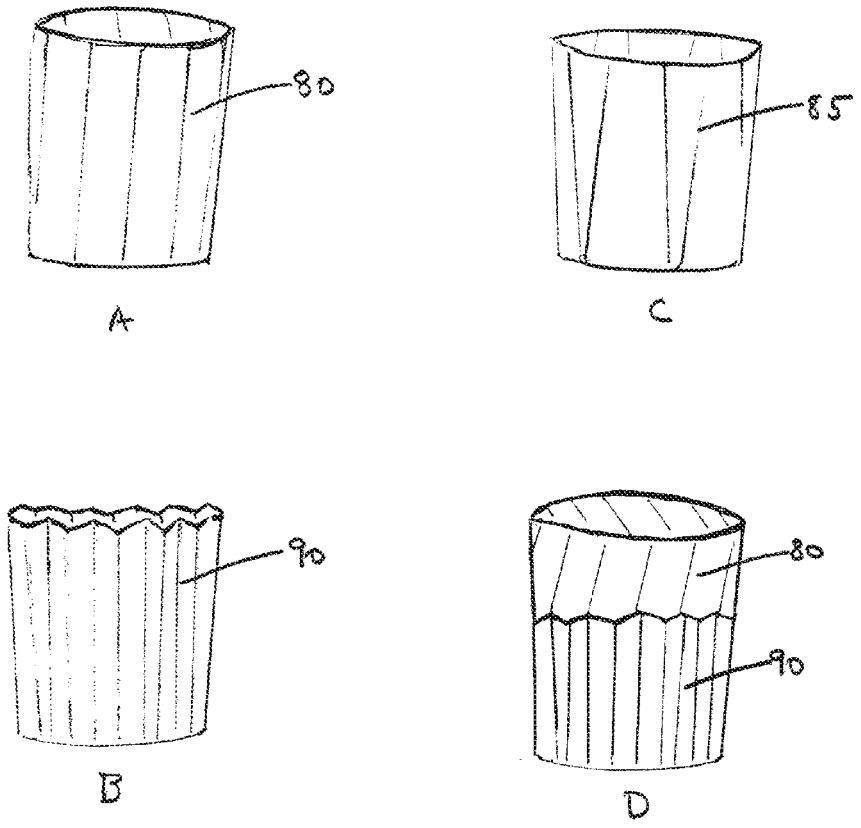
FIG. 2A illustrates a perspective view of a knife pleat in the side wall of the pleated cup in its pre-launched configuration according to this disclosure. This illustration represents a pleated cup that can be combined with a payload cup, and a pleated payload cup that contains the payload without a separate payload cup element.
FIG. 2B illustrates a perspective view of an accordion pleat in the side wall of the pleated cup in its pre-launched configuration according to this disclosure. This illustration represents a pleated cup that can be combined with a payload cup, and a pleated payload cup that contains the payload without a separate payload cup element.
FIG. 2C illustrates a perspective view of a box pleat in the side wall of the pleated cup in its pre-launched configuration according to this disclosure. This illustration represents a pleated cup that can be combined with a payload cup, and a pleated payload cup that contains the payload without a separate payload cup element.
FIG. 2D illustrates a perspective view of a pleated cup in its pre-launched configuration according to this disclosure, wherein the pleated side wall comprises aft portion accordion pleats in combination with fore end knife pleats. This illustration represents a pleated cup that can be combined with a payload cup, and a payload pleated cup that contains the payload without a separate payload cup element.
Figure 2A:
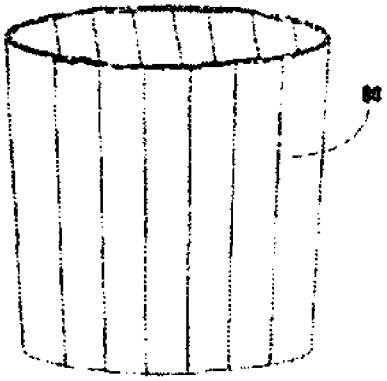
Figure 2C:
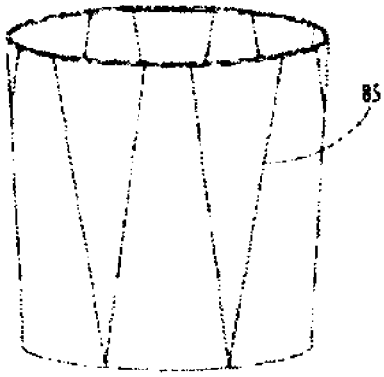
Figure 2B:
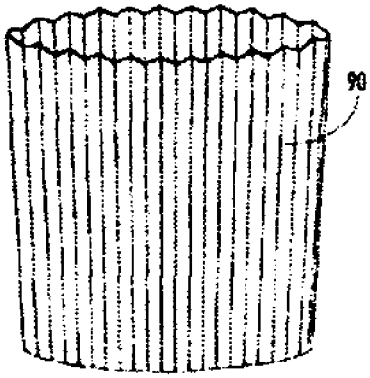
Figure 2D:
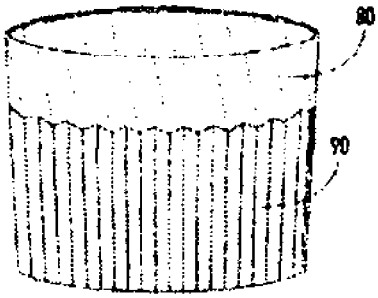

FIGS. 2A-D illustrate some of the common pleat structures that can be used in the pleated cup as provided by this disclosure. Each of the FIGS. 2A-D illustrations represent both a pleated cup that can be combined with a payload cup element, and a pleated cup that contains the payload without a separate payload cup element. FIG. 2A illustrates a perspective view of a knife pleat 80 structure in the side wall of the pleated cup of a payload delivery system in its pre-launched configuration. FIG. 2B illustrates an accordion pleat 85 structure and FIG. 2C illustrates a box pleat structure 90 in the side wall of the pleated cup of a payload delivery system in its pre-launched configuration. FIG. 2D illustrates a perspective view of a pleated cup of a payload delivery system in its pre-launched configuration in which the pleated side wall comprises aft portion accordion pleats in combination with fore end knife pleats. This configuration affords the advantages of the cushioning effect for the payload upon firing at the aft portion of the structure.

In one aspect, the pleated side wall of the pleated cup is found to impart an unexpected benefit to the function of the payload delivery system of the disclosed cartridge system. This function is illustrated by, but not limited to, a side wall comprising accordion pleats, which can function as a collapsible "crush section" upon launching the payload. In this aspect, accordion pleats can provide a cushioning effect for the payload upon firing, similar to the collapsible legs of a plastic wad used in shotshells. This effect is not limited to accordion pleats, but includes any pleated cup having pleats with relatively large volumes of dead space not filled by the folds of the pleat itself, such as in fluted pleats. Therefore, in one aspect, this disclosure provides for a pleated cup and/or a pleated payload cup having a lateral crush section, and its use in payload delivery systems of a cartridge.

Each of FIGS. 2A-2D further illustrate various embodiments of the "pleated payload cup", which combines the functions of the payload cup and the pleated cup into a single construction. Typically, a payload delivery system using the multi-purpose pleated payload cups can generally comprise, in its pre-launched configuration:

a) a pleated payload cup having an open fore end, a closed aft end, and a pleated side wall defining a cavity;

b) an obturating component adjacent the payload cup, comprising a pre-formed gas seal coaxially aligned with the payload cup or an obturating medium; and c) at least one payload contained within the cavity of the payload cup.

Because there is no separate payload cup and pleated cup as shown in FIGS. 1A-D, the FIGS. 2A-D constructions can be used for launching certain projectiles such as powders, gels, liquids contained in a breakable or rupturable container, and the like, for example, at relatively low velocities. In these situations, the pleated payload cup can provide a clean separation of the cup from the payload. Moreover, the FIGS. 2A-D constructions can be used for launching certain solid projectiles to which they are attached and therefore function as stabilizing components for the solid projectile. Again, the particular pleated structure is not limited as the pleated side wall 50 can assume any pleated structure that generally gathers the pleated cup material in a symmetric manner.

Figure 3:
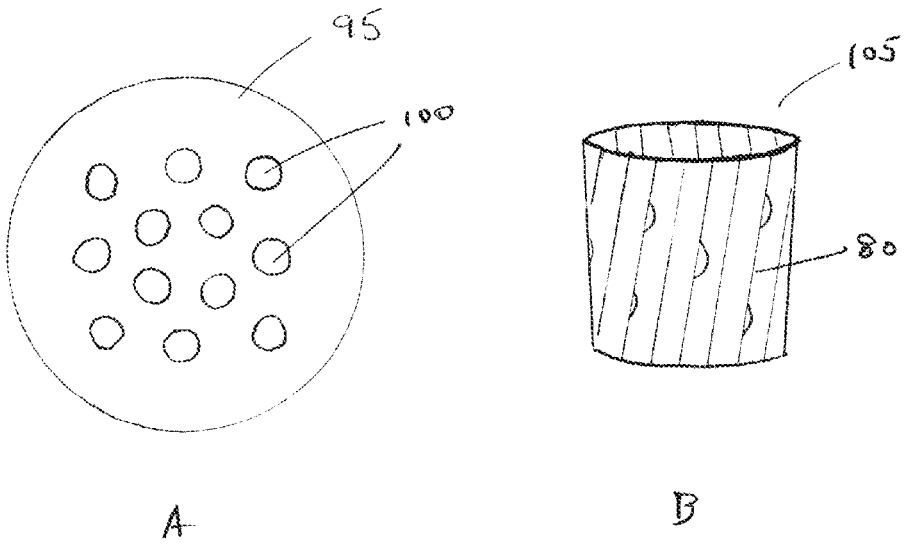
FIG. 3A illustrates one embodiment of a pre-pleated component that incorporates perforations that have been cut or punched in the pre-pleated component, prior to pleating and forming the pleated cup.
FIG. 3B provides a perspective view of a pleated cup with perforations, in its pre-launched configuration, which has been formed by pleating the pre-pleated component with perforations shown in FIG. 3A. In this embodiment, the side wall of this component has been pleated using knife pleats.
Figure 3A:
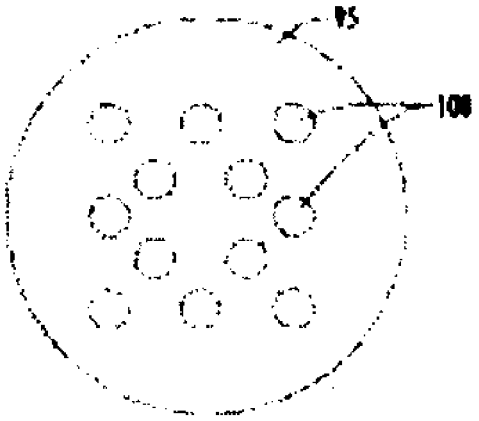
Figure 3B:
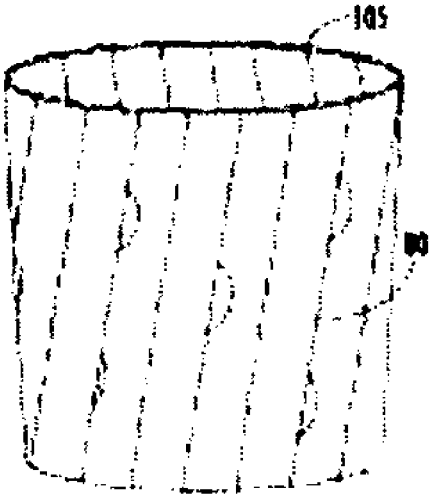

While the embodiments of FIGS. 1 and 2 are illustrated as having a solid side wall folded into a pleated structure, other aspects and embodiments of pleated cup side walls are also useful. For example, variously-shaped and -sized cuts, cut-outs, slits, holes, perforations, and the like, whether generally longitudinal, transverse, or otherwise, or combinations thereof, can be used to impart additional stabilizing influence on payload delivery system as it is launched. In this aspect, for example, perforations or cut-outs can be employed to provide various degrees of stability during flight, as a function of the number, size, and patter of the perforations or cut-outs. FIG. 3 illustrates a common modifications to a pleated cup 35 that can be used in accordance with this disclosure. Specifically, FIG. 3A illustrates one embodiment of a pre-pleated component 95 that has, for example, been cut into a circular shape from a sheet of suitable pleated cup material. As shown in FIG. 3A, perforations 100 have been cut or punched into the pre-pleated component 95 prior to pleating. This illustration represents a pre-pleated component that can be pleated to form either the pleated cup to be attached to a payload cup, or the pleated payload cup that contains the payload without a separate payload cup element. The perforations shown in FIG. 3A are merely illustrative of any number, size, shape, and pattern of cut-outs or perforations that can be included in the pre-pleated component for their stabilizing function. Such structures are more generally used as stabilizers in combination with a separate payload cup to which it is attached, because their use as stand-alone pleated payload cups can be limited as a result of perforations or cuts in the side wall. FIG. 3B provides a perspective view of a pleated cup with perforations 105 in its pre-launched configuration, which has been formed by pleating the pre-pleated component 95 with perforations shown in FIG. 3A. As illustrated, the side wall of this pleated cup with perforations 105 has been pleated using knife pleats 80. Such perforation or cut-out structures can further aid in stabilizing the payload delivery system as it unfolds and inverts after launching.

The pleated cup used in any disclosed embodiments of the payload delivery systems can be made of, or alternatively can comprise, any material that can be folded and pleated, including for example, paper, coated paper, paper composites, woven fabric, non-woven fabric, a wide range of polymers and plastics, various composites, various laminates, and the like. By way of example, the pleated cup can be made of, or alternatively can comprise, a polyolefin material, such as homopolymers or copolymers of polyethylene, polypropylene, and/or other olefin monomers. Paper that is coated on one or both sides with various polymers, resins, or other materials can also be used. Further, the pleated cup can be made of, or alternatively can comprise, various grades and types of paper, including any number of laminates or composites using such paper. In a further aspect, the pleated cup can be made of or alternatively can comprise a material that is from about 0.1 mil to about 25 mil in thickness, for cartridges that are generally applicable to being discharged while hand-held. However, this range is merely illustrative, as the thickness and size of the pleated cup can be altered as necessary to accommodate the requirements of the cartridge size, desired initial velocity and/or pressure on launching, and the like. Generally, there is no limit or restriction on the material thickness or material type that can be used according to this disclosure, as long as that sample can be folded into a pleated structure and used as provided herein.

While materials such as nonwovens comprising spun polyolefin fibers such as Tyvek® can be used as the pleated cup, for most applications, the pleated cup can be made of paper or a plastic material of some type, including materials that comprise paper or plastic. Suitable paper can include a wide range of basis weights and can be coated or uncoated. By way of example, a paper pleated cup can be coated to improve functional properties such as strength or stiffness or rigidity. Numerous paper coatings and their functional effect on the coated paper properties are well-understood in the paper art. Typical ingredients used in formulating a paper coating composition can include water, inorganic fillers, dispersants for the filler, binders and optional co-binders, water retention aids, rheology modifier to yield the proper viscosity profile to apply the coating, and the like.

The Payload Cup

Figure 4:
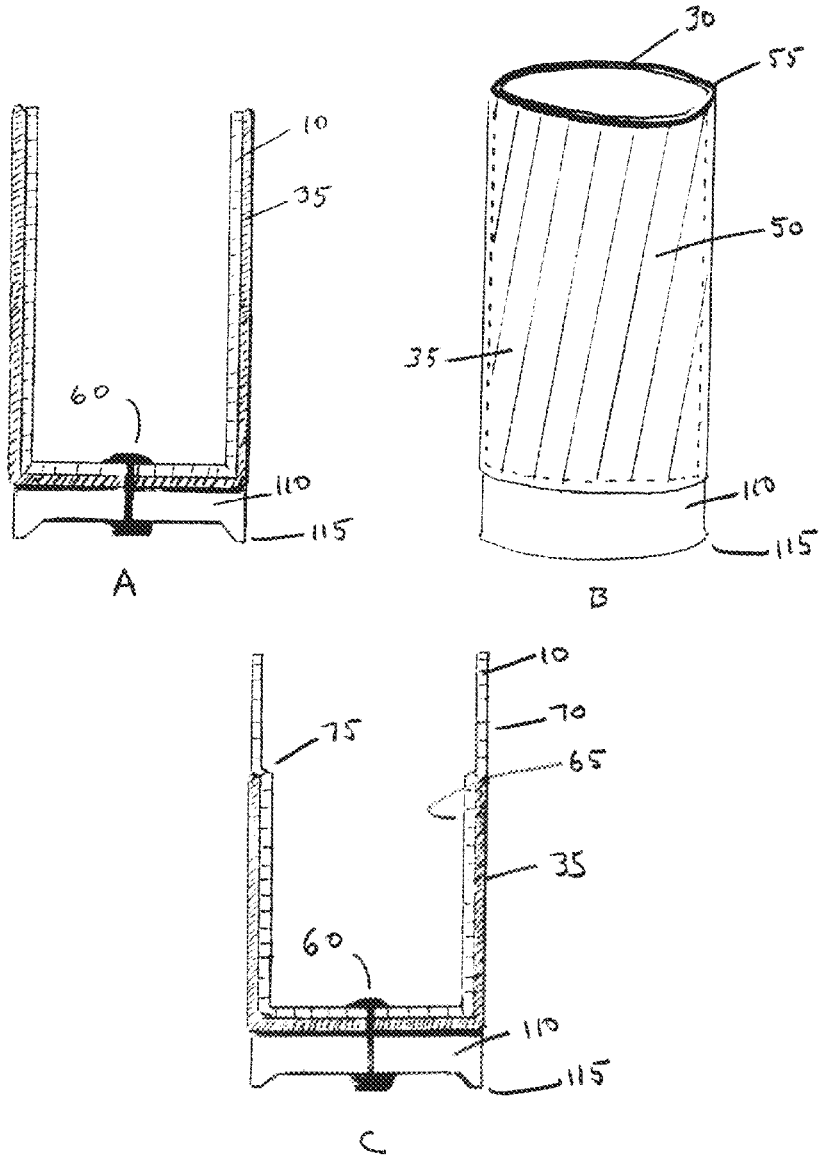
FIG. 4A illustrates a sectional view of a representative embodiment of a payload delivery system in its pre-launched configuration showing the payload cup, the pleated cup, a pre-formed gas seal, and the connector, as provided by this disclosure.
FIG. 4B illustrates a perspective view of a representative embodiment of a payload delivery system in its pre-launched configuration showing the relative arrangement of a knife-pleated cup which surrounds the payload cup, and a pre-formed gas seal. This arrangement represents those payload delivery systems that either: 1) attaches the payload cup, the pleated cup, and the pre-formed gas seal; or 2) attaches only the payload cup and the pleated cup, the combination of which sits atop a pre-formed gas seal.
FIG. 4C illustrates a sectional view of a representative embodiment of a payload delivery system in its pre-launched configuration showing the payload cup having a recessed aft portion as described by this disclosure, the pleated cup, a pre-formed gas seal, and the connector, as provided by this disclosure.

Generally, the materials used to construct the payload cup are well known and varied, and the payload delivery system is not limited to a particular material. For example, the payload cup can be made of, or alternatively can comprise, a range of polymers or plastics, paper including paper composites and laminates, combinations of polymers and paper such as coated paper or laminates of paper and polymers, and the like. A number of composite or laminate materials can be used. Unlike the pleated cup, the payload cup shown as 10 in FIGS. 1 and 4, retains its shape upon being launched. By way of example, the payload cup can be made of or alternatively can comprise a polyolefin material, such as homopolymers or copolymers of polyethylene, polypropylene, and/or other olefin monomers. Paper materials that are relatively stiff such as paper that is coated with various polymers, resins, or other materials can also be used, as can convoluted paper and other types of laminated materials.

Payload Delivery System Including an Integral or Separate Gas Seal

Many modern cartridges include a gas seal or obturating component, either as a separate element in the cartridge or formed as an integral part of projectile or payload container. For example, modern shotshell cartridges typically include a gas seal as a separate element in the cartridge or formed as an integral part of the wad and payload cup (shot cup) itself. As appreciated by the skilled artisan, the payload delivery system of this disclosure also can use any type of gas seal element known in the art. For example, a discrete pre-formed gas seal can be used to separate the powder charge from the payload delivery system and payload. Alternatively, so-called wadless technology described in U.S. Pat. No. 7,814,820 and U.S. Patent Application Publication No. 2011/0017090 by Menefee, both of which are incorporated herein by reference in their entireties, works well with the payload delivery system of this disclosure. In addition, embodiments having an integral gas seal component that is part of the payload delivery system itself also work well and are described here. For example, the connector that is used to attach the payload cup with the pleated cup can have a gas seal portion or "head" that directed toward the propellant when the connector is attached.

Figure 4A:
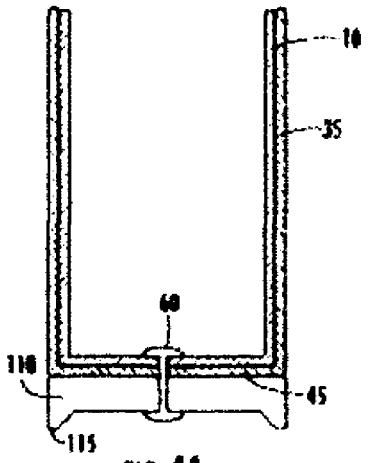
Figure 4B:
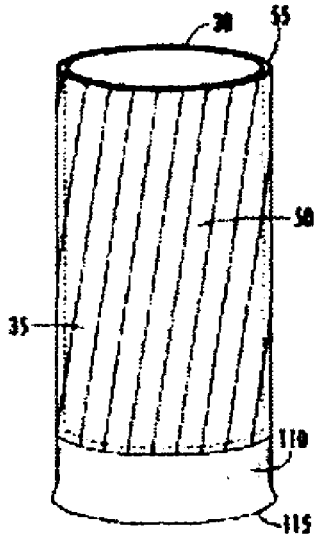
Figure 4C:
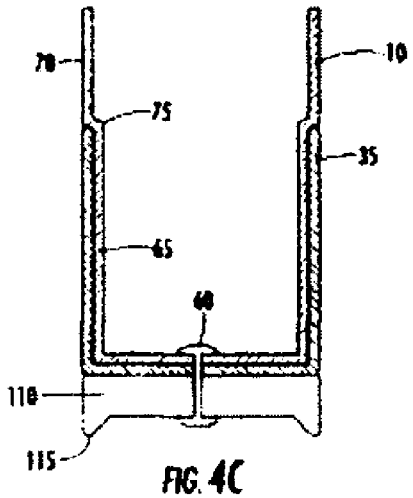

FIGS. 4A-B illustrate representative embodiments of a payload delivery system in its pre-launched configuration that includes a pre-formed gas seal 110 as an attached component of the payload delivery system that further includes the payload cup 10 and the pleated cup 35 as previously described.

FIG. 4A illustrates a sectional view of a representative embodiment of a payload delivery system in its pre-launched configuration showing the payload cup, the pleated cup, a pre-formed gas seal, and the connector, in which the gas seal 110 is attached to the aft end of the combined payload cup and pleated cup, and oppositely directed to achieve its gas seal function. In FIG. 4A, the pre-formed gas seal 110 is coaxially aligned with and oppositely directed to the payload cup 10 and the pleated cup 35, adjacent the rearward end of the pleated cup. Gas seal 110 has a side wall that generally defines a gas-sealing skirt 115. If desired, and as illustrated in FIG. 4A, the payload cup, pleated cup, and gas seal can be united by a connector 60, for example, the rivet-type connector shown in FIG. 4A, which is typically a plastic or polymer material. However, this connection of the gas seal to the remainder of the payload delivery system is not required.

FIG. 4B illustrates a perspective view of a representative embodiment of a payload delivery system in its pre-launched configuration showing the relative arrangement of a cup-shaped knife-pleated cup which surrounds the payload cup, and a pre-formed gas seal. This FIG. 4B arrangement represents those payload delivery systems that either: 1) attaches the payload cup, the pleated cup, and the pre-formed gas seal, corresponding to the FIG. 4A arrangement; or 2) attaches only the payload cup and the pleated cup, the combination of which sits atop a pre-formed gas seal. Thus, some embodiments can attach the gas seal to the aft end of the combined payload cup and pleated cup, while other embodiments can use a separate gas seal that is not attached or integral the payload cup and pleated cup combination.

Payload cup 10, pleated cup 35, and gas seal 110 can all be united by a connector 60, for example, the rivet-type connector shown in FIG. 4A, which is typically a plastic or polymer material for cost and ease of use purposes. As before, connector 60 of any type can be used to join the payload cup, pleated cup, and gas seal, for example, a rivet, a screw, a staple, a pin, a bolt, a brad, an anchor, an adhesive, a tack, or a nail of some type can be used.

Unfolding and Inversion of the Pleated Cup During Flight

Figure 5:
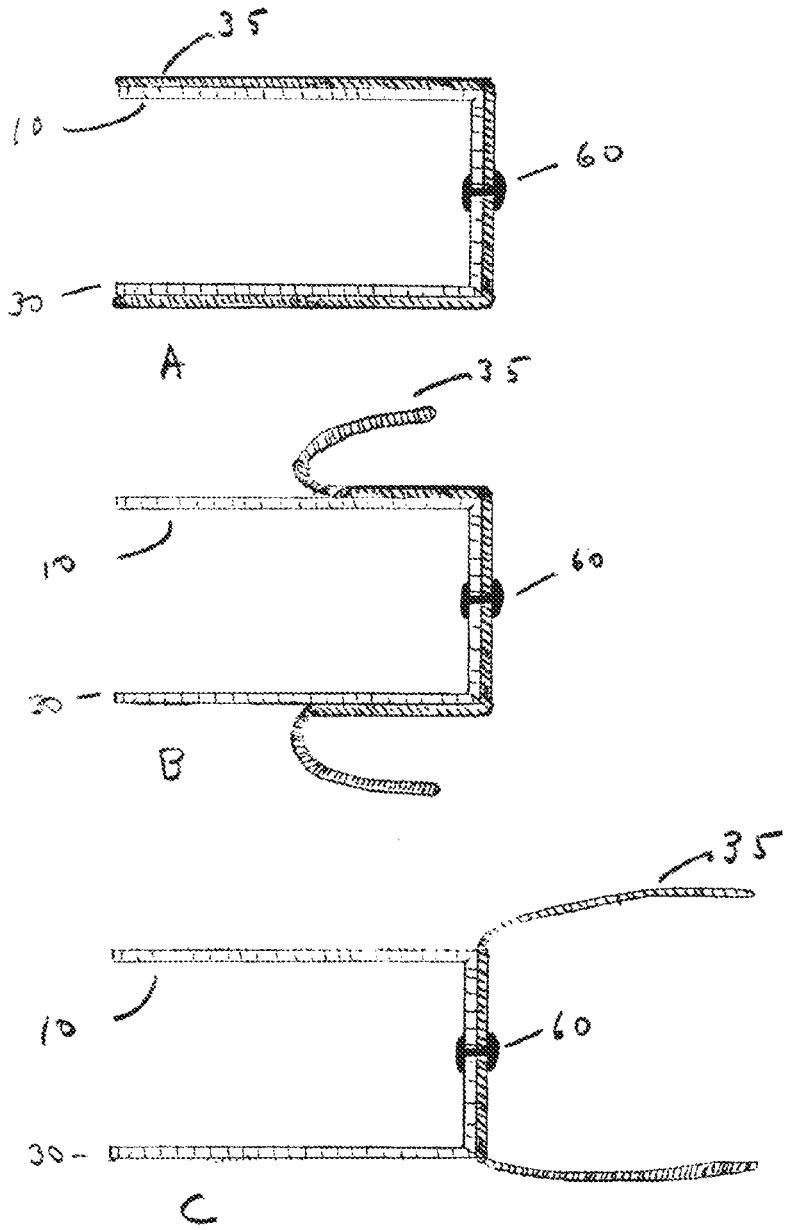
FIGS. 5A-C illustrate a progression of sectional views of the payload delivery system, without showing a payload or projectiles, as the pleated cup unfolds and inverts to slow the payload delivery system in a stabilized manner. The payload delivery system is illustrated before or instantly after firing (FIG. 5A, time 1), early in the unfolding stage (FIG. 5B, time 2), and later in the unfolding and inversion stage (FIG. 5C, time 3).
Figure 6:
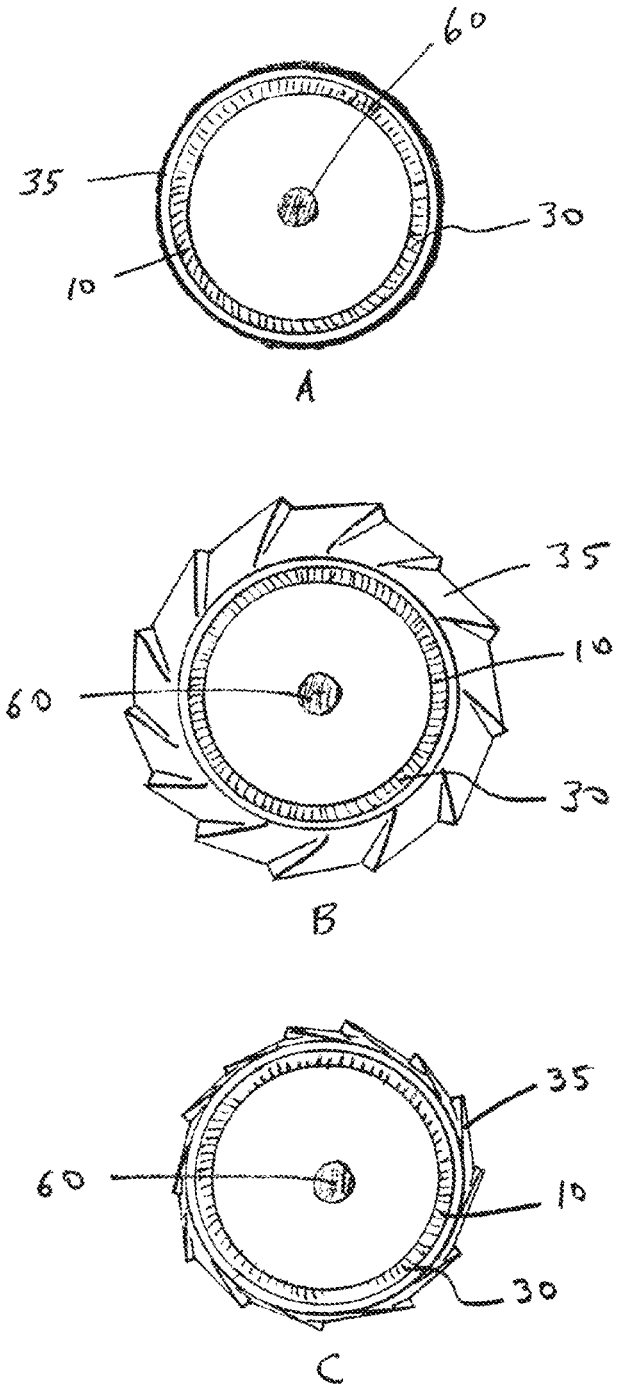
FIGS. 6A-C illustrate a progression of end-on views of the payload delivery system from a downrange perspective that correspond to FIGS. 5A-C, without showing a payload or projectiles, illustrating the pleated cup unfolding and inverting to slow the payload delivery system in a stabilized manner. The payload delivery system is illustrated before or instantly after firing (FIG. 6A, time 1), early in the unfolding stage (FIG. 6B, time 2), and later in the unfolding stage and following inversion (FIG. 6C, time 3).
Figure 5A:
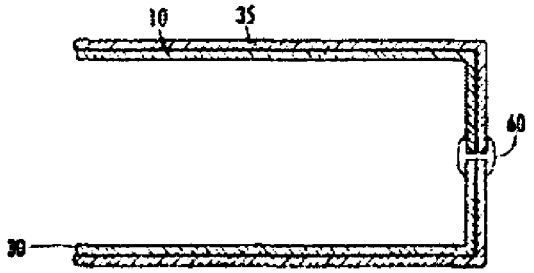
Figure 5B:
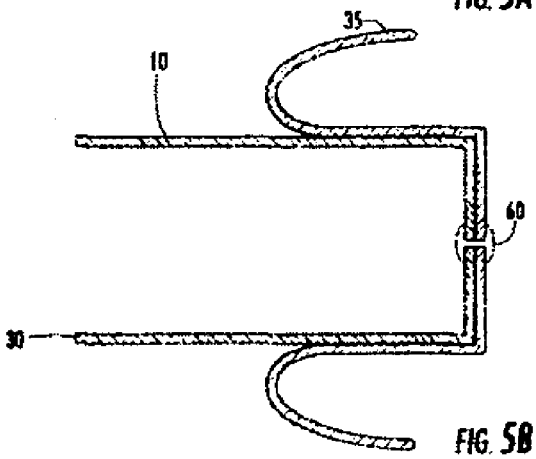
Figure 5C:
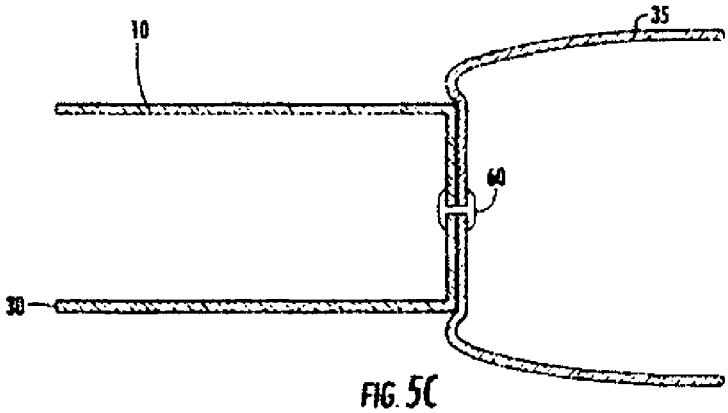

FIGS. 5A-C illustrate a progression of sectional views of the payload delivery system, which evolve over time and downrange distance, without showing its payload, as the pleated cup unfolds and inverts to slow the payload delivery system in a stabilized manner after firing. The payload delivery system is illustrated before or instantly after firing or launching the payload or projectile(s) from the cartridge (FIG. 5A, time 1), early in the unfolding stage (FIG. 5B, time 2), and somewhat later in the unfolding and inversion stage (FIG. 5C, time 3). While not intending to be theory bound, it is envisioned that later that time 3, further in flight, the pleated cup trails the payload cup and contacts the cup only by way of the connector 60. The high stability and high drag provided by the pleated cup, in turn, achieves a clean projectile or payload release from the payload cup. Seen in FIGS. 5A-C and FIGS. 6A-C are payload cup 10, payload cup rim 30, the pleated cup 35 in its various stages of unfolding and inverting (FIGS. 5B and C, FIGS. 6B and C), and the connector 60. While not intending to be limiting, FIG. 6 illustrates an embodiment characterized by the symmetric unfolding of a knife-pleated cup.

Figure 6A:
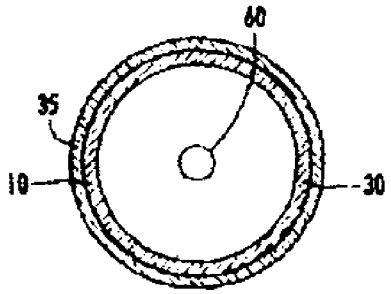
Figure 6B:
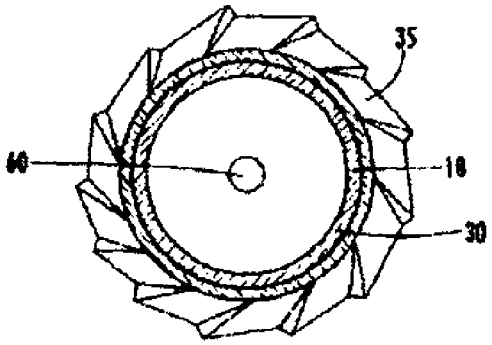
Figure 6C:
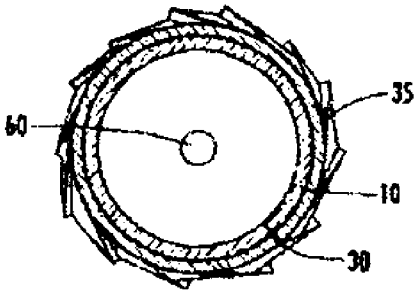

FIGS. 6A-C illustrate end-on views of the time and downrange distance progression of the same payload delivery system, corresponding to FIGS. 5A-C, as seen from a downrange observer. Thus, FIGS. 6A-C illustrate a progression of the payload delivery system from a downrange perspective without showing a payload or projectiles, illustrating the unfolding and inverting of the pleated cup to slow the payload delivery system in a stabilized manner. The payload delivery system is illustrated before or instantly after firing (FIG. 6A, time 1), early in the unfolding stage, with a view of the inside of the pleated cup, viewed from the pleated cup edge 55 at the pleated cup fore end 40 toward the pleated cup aft end 45 (FIG. 6B, time 2), and later in the unfolding stage and following inversion, with a view of the pleated cup, now viewed from the pleated cup aft end 45 toward the pleated cup fore end 40 (FIG. 6C, time 3). Thus, the exemplary knife pleats of FIG. 6 appear inverted in FIG. 6C relative to FIG. 6B, because inversion has occurred at this stage and the observer views the pleats from a different direction along the pleated cup side wall 50.

While not intending to be theory bound, the pleated cup can be used in cartridges that launch their payloads supersonically such as shotshells, and in cartridges that might launch their payloads sub-sonically, such as certain flare or chemical cartridges. When initial velocity of the payload system is supersonic, the pleated cup maintains its forward facing configuration until after it is launched and is in flight. Again, while not theory-bound, it is expected that once clear of the constrictions of a cartridge or launching tube, a supersonically launched payload system will open its pleated cup rapidly with assistance from sonic shock waves and not necessarily from drag, whereas in subsonic launching, the opening of the pleated cup is expected to be more draft and air resistance influenced.

Partial opening of the pleated cup exposes additional amount or area of the pleated cup material to air resistance, a feature made possible by the pleated structure that initially retained the additional material in a folded configuration. As unfolding progresses, the amount of exposed area of stabilizing material increases as the wad structure moves further downrange. Moreover, the pleated cup also begins to invert as unfolding advances, much like an umbrella is inverted by a strong gust of wind. Late in the trajectory of such a payload delivery system, it is likely that the pleated cup trails the payload cup and generally contacts the cup only by way of the point or area of connection to the payload cup. Therefore, this opening and reversal of direction of the pleated cup imparts high stability and high drag to what it is attached, which, in turn, achieves a clean projectile or payload release from the payload cup.

Again, while not intending to be bound by theory, it is believed that the pleated cup may function in a similar manner as a shuttlecock, that is, it adds high drag and high stability to the wad structure as it releases its projectile or payload. Because the disclosed design is extremely aerodynamically stable and tends to re-orient when subjected to destabilizing forces, the pleated cup will resist the tendency to yaw and pitch that would degrade flight stability and performance of the payload as it releases from its delivery system. In the present design and like the shuttlecock, the pleated cup remains attached to the payload cup for continual stability and drag and thereby enhancing ballistic performance.

The opening of the pleated cup and/or the drag imparted by the pleated cup to the payload delivery system can be regulated as desired, for example, by adjusting the longitudinal length of the side wall 50 of the pleated cup and/or by the size, shape, and number of the perforations, cut-outs, or slits in its side wall 50. Again, while not intending to be theory bound, it is thought that the location of the pleated cup on the aft portion of the payload delivery system, that is, on the bottom (primer end or uprange end), helps impart the shuttlecock stabilizing effect. This feature contrasts with conventional one-piece plastic wads having longitudinal slits in the shot cup which form petals that peel open during flight. Stiff wads such as used in shotshells for steel shot can have petals that may open up unevenly and inconsistently, and the resulting instability can cause the opening wad to tumble, pitch, or yaw before clean separation of the wad from the shot column has been achieved.

Crimped Payload cups

Figure 7:
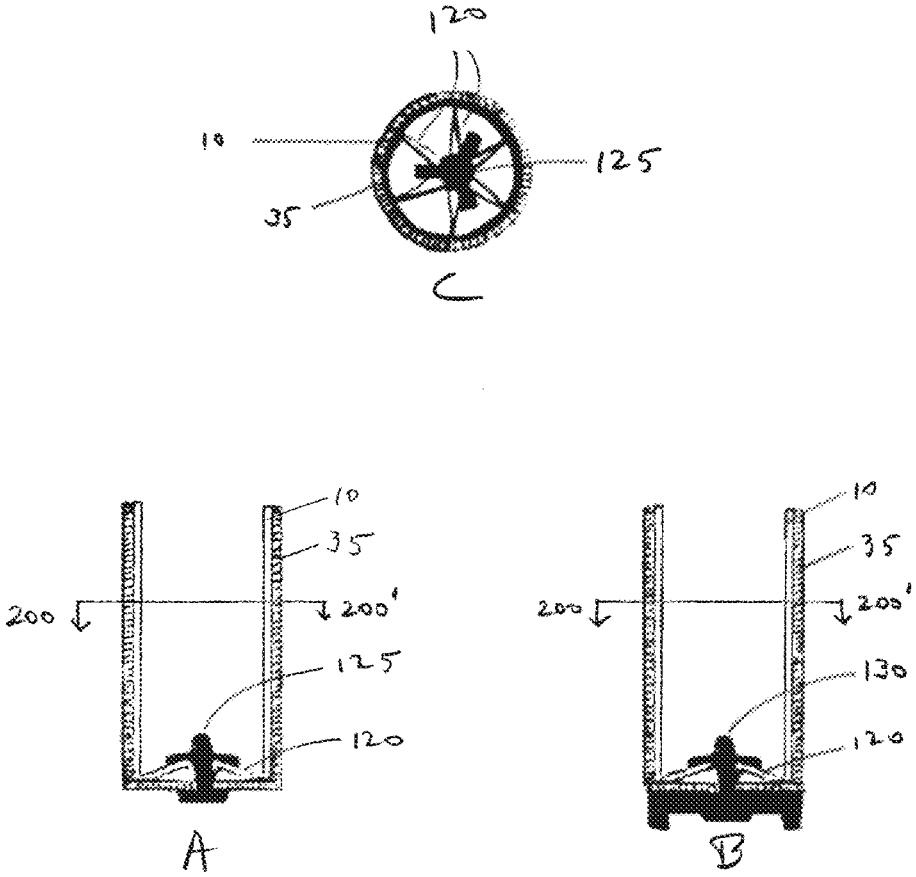
FIG. 7A illustrates a sectional view of a representative embodiment of a payload delivery system in its pre-launched configuration showing the payload cup, the pleated cup, and the connector, in which the aft end of the payload cup is crimped closed. In the illustrated embodiment, the connector is a blind rivet that holds the pleated cup to the crimped end of the payload cup.
FIG. 7B illustrates a sectional view of a representative embodiment of a payload delivery system in its pre-launched configuration showing the payload cup, the pleated cup, the pre-formed gas seal, and the connector, in which the aft end of the payload cup is crimped closed. In the illustrated embodiment, the connector is a blind rivet that holds the pleated cup to the crimped end of the payload cup, in which the pre-formed gas seal forms the head of the rivet connector and is an integral part thereof, such that the unitary gas seal-rivet attaches the payload cup and the pleated cup. This arrangement can also represent those payload delivery systems in which the pre-formed gas seal is a separate component that is attached to the payload cup having a crimped aft end to the pleated cup with the rivet connector.
FIG. 7C provides an end-on view of the representative embodiments of a payload delivery system in its pre-launched configurations of FIG. 7A and FIG. 7B, viewed perpendicular to the 200-200' line, and showing the payload cup, the pleated cup, and the connector, in which the aft end of the payload cup is crimped closed using a 6-point star crimp. In the illustrated embodiment, the connector is a "tri-grip" triangular blind rivet that accommodates the 6-point star crimp to hold the pleated cup to the crimped end of the payload cup very tightly.

Among other things, this disclosure provides for a cylindrical payload cup having an open fore end and a closed aft end and a pleated cup that is nested within with the payload cup. According to one aspect, the payload cup can have a closed aft end that is closed by crimping said aft end. By closing the aft end of the payload cup by crimping, a structure and method of forming the closed payload cup can be attained at low cost and with minimal retooling and capital costs. Moreover, by using a simple connector such as a pop rivet, the entire crimped payload cup, pleated cup, and connector structure can be obtained easily and at low cost. FIG. 7 illustrates some of the many embodiments of this aspect of the present disclosure.

Figure 7A:
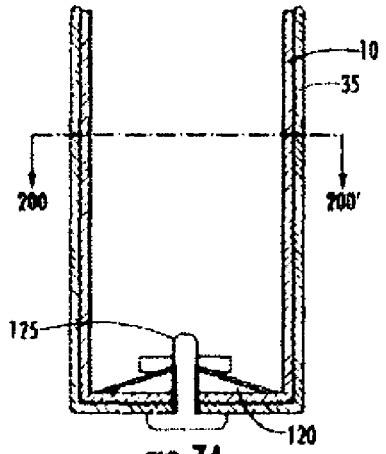

FIG. 7A illustrates a sectional view of a representative embodiment of a payload delivery system in its pre-launched configuration showing the payload cup, the pleated cup, and the connector. In this figure, the aft end of the payload cup is crimped closed using a 6-point star crimp, and the connector extend all the way through the pleated cup and the crimped aft end of the payload cup to join these elements. In the illustrated embodiment, the connector is a blind rivet that holds the pleated cup to the crimped end of the payload cup.

Figure 7B:
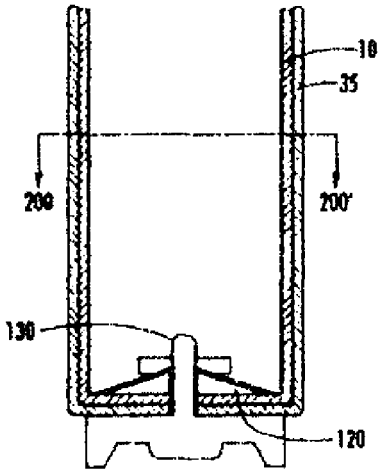

Similarly, FIG. 7B illustrates a sectional view of a representative embodiment of a payload delivery system in its pre-launched configuration showing the payload cup, the pleated cup, the pre-formed gas seal, and a connector. In FIG. 7B, the aft end of the payload cup is crimped closed using a 6-point star crimp. Moreover, in the illustrated embodiment of this figure, the connector is a blind rivet that holds the pleated cup to the crimped end of the payload cup, in which the pre-formed gas seal forms the head of the rivet connector and is an integral part thereof, thereby forming a unitary gas seal-rivet piece. In this illustrated embodiment, the unitary gas seal-rivet attaches the payload cup and the pleated cup in the usual fashion, and also functions as a pre-formed gas seal. This FIG. 7B arrangement can also represent those payload delivery systems in which the pre-formed gas seal is a separate component that is attached to the payload cup having a crimped aft end to the pleated cup with the rivet connector. Therefore, this disclosure further provides for a unitary pre-formed gas seal comprising:

a) a gas seal portion having a side wall that defines a gas-sealing skirt; and b) a connector portion integral to the gas seal portion;

wherein the gas seal portion and the connector portion are coaxially aligned and oppositely directed.

Figure 7C:
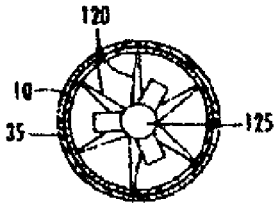
Figure 8:
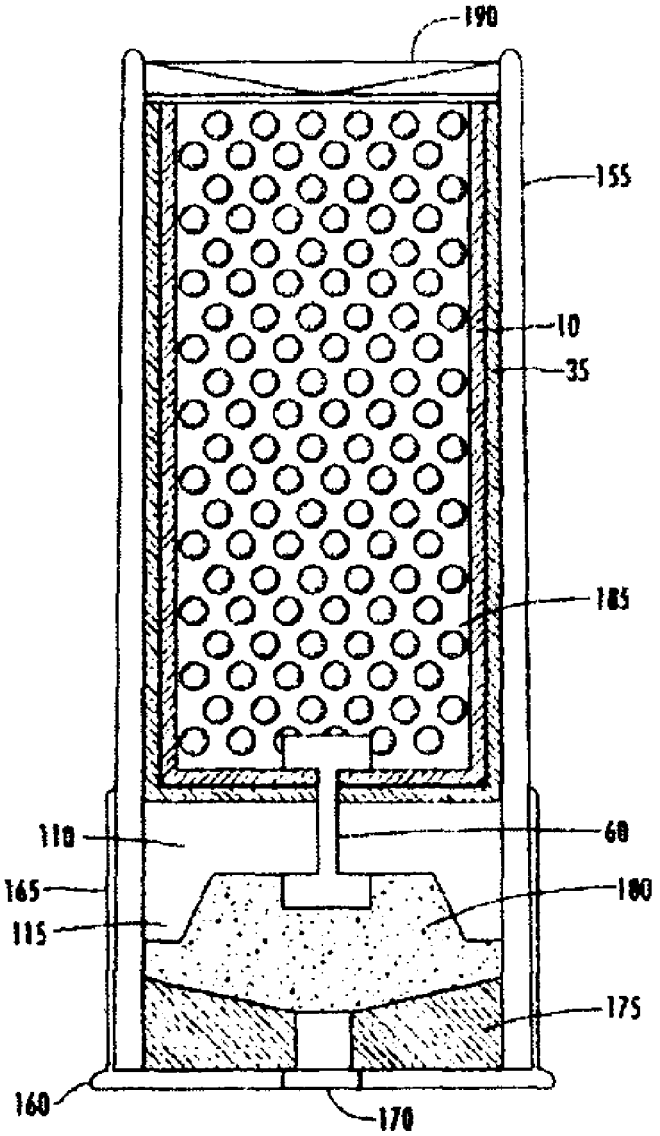

FIG. 7C provides an end-on view of the representative embodiments of a payload delivery system in its pre-launched configurations of FIG. 7A and FIG. 7B, viewed perpendicular to the 200-200' line into the open end of the payload cup, and showing the payload cup, the pleated cup, and the connector. In the embodiment shown in FIG. 7C, the aft end of the payload cup is crimped closed using a 6-point start crimp, although this aspect is not limited to a specific type of crimp. In the illustrated embodiment, the connector is a "tri-grip" triangular blind rivet that accommodates the 6-point star crimp to holds the pleated cup to the crimped end of the payload cup very tightly.

Use of Wadless Gas Seal Technology with the Payload Delivery System

As provided in this disclosure, the gas seal that separates the powder charge from the rest of the payload delivery system and payload can constitute a separate structure from the payload cup and pleated cup combination, it can be an integral gas seal that is part of the payload cup and wad structure, or the so-called wadless technology using a granulated obturating medium can be used to seal the gases from the ejecta. Wadless materials and methods that are suitable for use with the payload delivery system of this disclosure are described in U.S. Pat. No. 7,814,820 and U.S. Patent Application Publication No. 2011/0017090 by Menefee, both of which are incorporated herein by reference in their entireties. While not intended to be limiting, wadless technology may be useful in launching powders and gels and the like relatively short distances, such as in a cartridge designed for distributing powders indoors or generally within closed confines.

As provided in the incorporated references, the wadless technology provides an extremely versatile system to launch a wide range of projectiles downrange. In this aspect, for example, the cartridge can comprise:

a) a cartridge case having a fore end and an aft end and, comprising a primer situated at the aft end;

b) a propellant adjacent the primer;

c) an obturating medium adjacent the propellant;

d) a payload delivery system adjacent the obturating medium, in which the payload delivery system comprises 1) a payload cup having an open fore end, a closed aft end, and a cylindrical side wall defining a cavity;

2) a pleated cup coaxially aligned with the payload cup, having an open fore end, a closed aft end, and a pleated side wall defining a cavity that terminates at an edge contiguous with the open fore end, wherein the payload cup is nested within the pleated cup such that the payload cup aft end is adjacent the pleated cup aft end; and 3) a connector that unites the payload cup and the pleated cup. and e) at least one projectile at least partially contained within the cavity of the payload cup;

wherein the cartridge does not contain a pre-shaped gas seal.

The obturating medium is not a pre-formed gas seal, but is usually a finely divided or granular medium such as a particulate polyolefin, which is generally contiguous with the propellant and which forms into a dense obturating mass when subjected to the pressure of firing the cartridge.

In one aspect, the material constituting the obturating medium can be in the form of particles of any shape. For manufacturing ease, the obturating medium generally can be free-flowing and non-agglomerated. A range of sizes and size distributions of particles are useful as obturating medium. According to one aspect and by way of example, a suitable obturating medium can be one that generally combines the properties of irregularly shaped particles and the small particle sizes disclosed herein. While not intending to be bound by theory, it is believed that, among other things, irregularly-shaped particles impart a high critical angle of repose to the obturating medium, which may also reflected in the ability of the particles to interlock or bridge. Also while not intending to be bound by theory, it is thought that under the extreme shear stress of the rapidly expanding combustion gases, the obturating medium behaves in a non-Newtonian fashion, conforming to parameters of the chamber throat or forcing cone and obturating the hot gases, while protecting and insulating the projectile(s).

Other features of suitable particles for the obturating medium can be found in U.S. Pat. No. 7,814,820 and U.S. Patent Application Publication No. 2011/0017090. For example, there does not appear to be a lower limit of suitable particle sizes that work. Combinations of more than one type or material or particle can be used to form the obturating medium, each of which can have the same approximate upper limit of useful particle sizes for good obturating effect. In one aspect, low density polyethylenes such as the Microthene® MN 701 series of polyethylenes from Equistar work well, either alone or in combination with other obturating media materials.

In accordance with another aspect of the wadless technology, a flow control additive can be used in conjunction with the obturating medium during loading and manufacturing, if desired. A flow control additive usually takes the form of particles that can be larger than the obturating medium particles and have antistatic or non-static properties. Typically, the volume fraction of the flow control component is less than the volume fraction of the obturating medium particles. For example, a portion of 2 parts by volume of obturating medium combined with a portion of 1 part by volume of a flow control component can be used. The smaller and the larger particles can have the same composition or can have different compositions. For example, a combination of small polyethylene or polypropylene obturating particles with larger polyethylene or polypropylene flow control particles provides a useful "combination" obturating material. In this aspect, for example, a relatively small size of low density polyethylene obturating material in combination with a larger particle size polypropylene flow control additive is useful for improved flow properties.

The composition of the obturating medium can be selected from any number of thermoplastics, thermosets, elastomers, thermoplastic elastomers, and other materials, including combinations thereof. A suitable obturating medium acts as a good seal under pressure, while also providing a thermal insulating effect which insulates and protects the projectile(s) from the intense heat of the powder combustion. This insulating effect of the obturating medium of this disclosure is provided without the obturating medium melting together to form a solid mass from the intense heat of combustion. This thermal insulating and gas-sealing effect of the obturating medium also allows a wide range or projectile types to be launched from a cartridge, and specifically permits the use of a paper or fabric pleated cup in the payload delivery system. The obturating medium also provides a cushion effect on the projectile(s) reducing deformation. In one aspect, suitable obturating medium compositions include, but are not limited to, various polyethylenes, polypropylenes, ethylene alpha-olefin copolymers (for example ethylene-1-hexene copolymers), propylene alpha-olefin copolymers (for example propylene-1-hexene copolymers), ethylene vinyl acetate copolymers, and the like, including any combinations or mixtures thereof, any polymer alloys thereof, or any copolymers thereof. Useful polyethylenes include high density polyethylenes, low density polyethylenes, and linear low density polyethylenes. Readily available and inexpensive low-density polyethylene, polypropylene, and combinations of polyethylene and polypropylene are suitable and relatively low cost obturating medium materials, which can provide a manufacturing advantage.

Applications to Shotshells

In one aspect, the disclosed payload delivery system is applicable to shotshell "wad" designs or muzzle-loading wad designs for firearms and other types of muzzle-loading payload launchers. Shotshell wads of various designs have been used in loading shotshell ammunition to separate the propellant from the shot, to provide a seal against hot expanding propellant gases, and more recently, to protect the barrel itself from direct contact with hard shot. Early shotshell wads were made of cardboard type materials and were used generally as over-powder wads, often in combination with fiber, cork, felt, or pressed paper filler wads. Thin card wads were also used as over shot barriers for the older roll crimped cartridges. Card wads withstood the heat of combustion very well and were simple and low cost materials. However, these early wads required rather precise internal shell dimensions for proper fit, and even then, their gas sealing properties were only moderate. Moreover, early wads offered little cushioning effect for the soft lead shot and provided no protection from direct contact with the bore; therefore some degree of shot deformation and inconsistent patterns resulted. Improvements in gas sealing were realized with Winchester's so-called "bottle cap" cup wad introduced in the mid-1940s, which helped point the way to further advances.

Next generation wads for lead shot were plastic constructions that incorporated a flanged or slightly flared over-powder cup to provide an obturating gas seal, which was integral with a shot cup to contain and protect shot from direct barrel contact. These structures included a collapsible section interposed between the over-powder gas seal and the shot cup. Such one-piece plastic wads improved the gas sealing properties and enhanced shot integrity by the cushioning effect of the collapsible section and elimination of direct barrel contact, all of which afford improved and consistent downrange shot patterns. Longitudinal slits in the shot cup portion are typical, and these slits form petals in the cup that open up to peel away the wad from the shot column after firing. Similar plastic constructions have been adapted as sabots for single slug projectiles. While one-piece plastic wads offer certain improvements over earlier materials, their complexity and the costly tooling requirements for their manufacture can make these wads less attractive than simpler designs.

With the advent of steel and other hard shot, the barrel protection function of the wad became paramount and its shot cushioning function of less concern. As a result, steel shot wads generally dispense with any collapsible section between the gas seal and the shot cup, and steel shot wads are typically constructed of much thicker plastic to prevent shot from penetrating the shot cup itself and contacting the barrel. The thickness of the plastic wads can be problematic, often leading to high pressures upon firing and affording inconsistent opening of any petals that are pre-slit in the shot cup portion. Moreover, the consistent cutting of slits into the thick plastic walls can itself present a challenge, and their very presence may allow hard steel shot to penetrate the side wall and contact the barrel under the high pressures of firing the cartridge. The aerodynamic stability of such designs are only fair, and complete separation of the wad from the shot column may not occur before tumbling ensues and degrades its subsequent trajectory. Attempts to address these issues have required complex designs at a substantial increase in cost. In this aspect, designs with thick petals that expand from the front and/or rear, or wads with break-away portions or complex constructions have been claimed, for example, as disclosed in U.S. Pat. Nos. 4,773,329, 6,260,484, 5,979,330, and 5,874,689.

When the disclosed payload delivery system is used in loadings for shot, the stability of the system allows for clean separation of the wad structure from the shot column and provides consistent patterns and accurate delivery of the payload. While any type of shot or other projectile can be used with this payload delivery system, its performance with steel and other hard shot is an improvement over the aerodynamic stability of conventional thick plastic wads used for steel shot. Moreover, the pleated cup can be adjusted for the desired load and application, such that tight patterns can be delivered accurately at ranges that are difficult to achieve using traditional wads. For example, the length of the side wall of the pleated cup, the pleat structure, the inclusion of cut-outs, slits, perforations, and the like in the side wall of the pleated cup, the thickness of the pleated cup material, and the nature of the material itself, can all be adjusted to "tune" the overall payload delivery system for the desired performance.

Typically, when using steel or other hard shot, the side wall of the payload cup does not include perforations or cut-outs. Therefore, there are no problems arising from the penetration of hard shot through the wad system and contacting the barrel. Moreover, when the payload delivery system includes two layers—a payload cup and a pleated cup—a temporary lamination effect results that provides strength to the complete payload delivery system. This lamination strength allows for relatively thin payload cups to be used even for steel shot, much like the thinner shot cups traditionally suitable only for lead shot. As a result, this present system provides the necessary barrel protection function, allows a clean separation from the shot column to provide good patterns, and avoids complicated molded features that increase costs.

According to one aspect, the payload delivery system is sufficiently versatile for use in loading large or small bird shot, buck shot, or slugs. Shotshell cartridges loaded with the payload delivery system can otherwise employ standard shotshell components and loading methods for their construction. By way of example, the shotshell cases or hulls, primers, propellant or powder, shot or other projectiles such as slugs, gas seals when the selected gas seal is not integral to the payload delivery system and is not a wadless obturating medium, and the like, have all been described in abundant detail. Treatises and handbooks that can be referenced for describing suitable other components include Thomas J. Griffin, editor, *Shotshell Reloading Handbook,* 5$^{th}$ ed., Lyman Publications, Lyman Products Corporation, Middletown, Conn., c. 2007 and Don Zutz, *Hodgdon Powder Company Shotshell Data Manual,* 1$^{st}$ ed., Hodgden Power Company, Shawnee Mission, Kans., c. 1996.

Any variety of projectile types, shapes, and number can be loaded into a cartridge such as a shotshell using the payload delivery system disclosed herein. For example, all sizes of lead, lead-containing, lead-free, frangible, penetrating, and other projectiles can be employed, including all sizes of birdshot, buckshot, and slug projectiles. Any combination or mixture of shot sizes can be advantageously loaded using payload delivery system as provided herein. This technology is further applicable to ammunition loaded with shot comprising or consisting of steel, bismuth, tungsten, tin, iron, copper, zinc, aluminum, nickel, chromium, molybdenum, cobalt, manganese, antimony, alloys thereof, composites thereof, and any combinations thereof. These shot loadings can be standard loadings, buffered loadings, duplex loadings, loadings using any conventional configuration, whether simple or complex. For example, shot loadings can comprise at least one additional wad used with the payload delivery system according to this disclosure.

By way of example, some embodiments of the cartridge payload delivery system of this disclosure can be used to launch single solid projectile, which can be accomplished in combination with a pleated cup. In these configurations, and not as a limiting feature, the solid projectile can use an optional spacer or plug, which can be in contact with and, if desired, can be attached to the aft portion of the solid projectile in its pre-launched configuration. While the spacer can be used to fill any void space for properly matching the cartridge contents to the available cartridge space, the pleated cup can function as a sabot for the solid projectile. When a pleated cup is used with a sub-bore diameter single projectile, regardless of whether a spacer is used or not, the sabot effect of the pleated cup centers the projectile within the bore, imparts cushioning properties, and boosts accuracy. This aspect of using the pleated cup itself as a solid projectile cup or sabot allows tailoring the pleated cup such that it can fill all available space between the single projectile and the actual bore diameter of the launching device, such as a firearm, a concept that is carried over to using the pleated cup with a separate payload cup.

As illustrated in FIGS. 5 and 6 that show the unfolding and inversion of the pleated cup, after firing the solid projectile-pleated cup combination, in which the pleated cup is attached to the solid projectile with or without a spacer, the pleated cup unfolds and inverts to slow the payload delivery system in a controlled manner. Alternatively, when the pleated cup is not attached to the solid projectile, the pleated cup opens and itself slows to cleanly release the solid projectile payload. If desired, a payload cup element also can be used in combination with a solid projectile and pleated cup component, if so desired. Further, the projectile can include a rounded fore end while the aft end of the can be closed about the rear of the projectile, which optionally can be partially hollow, or the aft end of the projectile can be open. Any additional structures or features that are conventionally used in loading solid projectiles, for example slugs, can be used with the pleated stabilizing payload delivery system of this disclosure, as long as the additional structures or features do not interfere with the loading or function of the payload delivery system and pleated cup as described herein.

Other cartridge systems can advantageously use the pleated cup of this disclosure, including but not limited to, an ammunition cartridge, a flare cartridge; a grenade launcher cartridge, a smoke flare cartridge, a signaling device cartridge, a chemical munitions cartridge, a distraction device cartridge, or a pyrotechnic launching device cartridge. Thus, specialty cartridges using the disclosed payload delivery system also can be advantageously loaded with, for example, frangible projectiles, lead projectiles, non-lead metal projectiles, steel projectiles, rubber projectiles (for example, rubber shot and rubber baton projectiles), bean bag projectiles, tear gas- or oleoresin capsicum (OC)-containing projectiles, liquid-filled marking projectiles, tracer projectiles, penetrator projectiles (for example, steel penetrator or armor-piercing projectiles), flechette projectiles, incendiary projectiles (for example, titanium sponge-containing projectiles and zirconium sponge-containing projectiles), flare projectiles, and the like, or any combination thereof.

Figure 8:
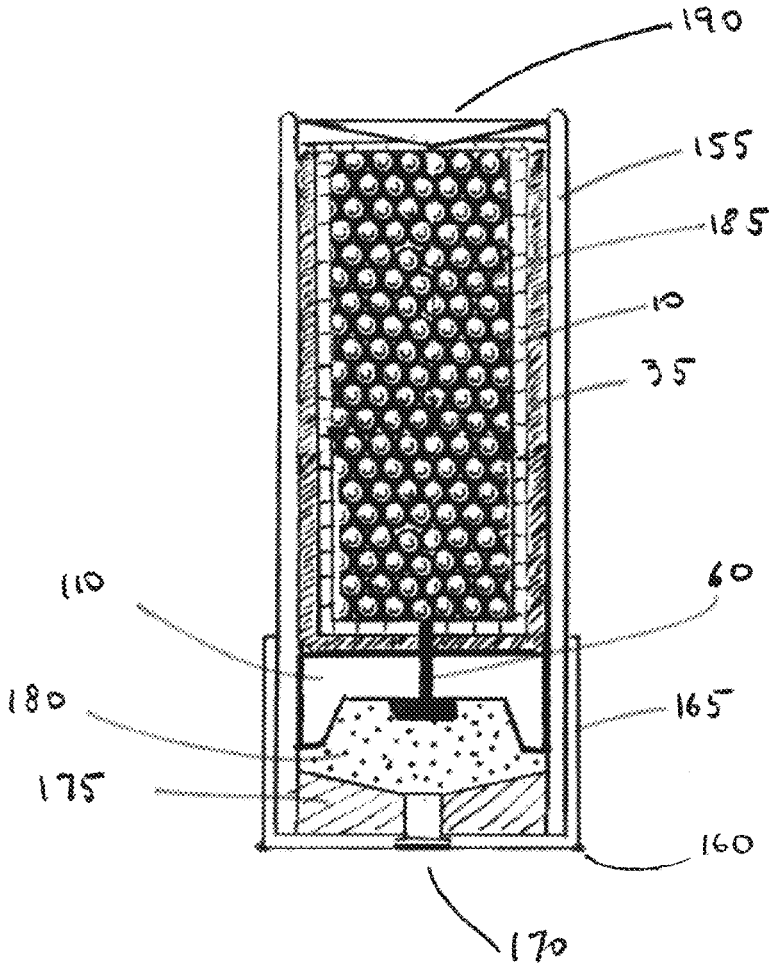
FIG. 8 illustrates a sectional view of one embodiment of a loaded shotshell using the payload delivery system according to this disclosure, in which the pleated cup of FIG. 4A or 4B is illustrated in its pre-launched and pre-inverted condition in a loaded cartridge.

FIG. 8 illustrates one embodiment of a shotshell that incorporates the payload delivery system with pleated cup according to this disclosure. This figure is intended to be non-limiting and demonstrate a simplified schematic of one way the payload delivery system of the present disclosure can be loaded and used. Full details of shotshell components such as shotshell hulls, primers, propellants, shot and the like can be found in various handbooks, such as Thomas J. Griffin, editor, *Shotshell Reloading Handbook,* 5$^{th}$ ed., Lyman Publications, Lyman Products Corporation, Middletown, Conn., c. 2007 and Don Zutz, *Hodgdon Powder Company Shotshell Data Manual,* 1$^{st}$ ed., Hodgden Power Company, Shawnee Mission, Kans., c. 1996.

In the illustration of FIG. 8, the arrangement of the shotshell components is demonstrated which employs the payload delivery system as illustrated in FIG. 4A in a shotshell construction. Thus, FIG. 8 illustrates, for example, the shotshell case 155 and its rim 160, the brass or head 165, the primer 170, base wad 175, and propellant 180 adjacent to the gas seal 110. The gas seal of FIG. 8 is a pre-formed gas seal 110 which is shown connected by connector 60 to the pleated cup 35 and the payload cup 10, and adjacent the rearward end of the pleated cup. The payload cup 10 houses the shot 185, and the shell can be crimped at the forward end with a star- or fold-crimp 190 of some type, such as a 6- or 8-point star crimp. This figure is not intended to be limiting, as any shotshell can be loaded with the payload delivery system of this disclosure, using standard procedures known to one of ordinary skill, and as described in the various treatises and handbooks such as those referenced.

In another aspect, additional cartridge components can be used with the present payload delivery system in shotshell or other cartridge loadings, as long as loading and firing that component in the cartridge does not adversely affect the utility of the disclosed payload delivery system. For example, upon firing a shotshell the column of shot pellets contained in the shot cup portion of the payload delivery system initially resists the acceleration and "set back" forces are applied by the shot in a rearward direction to the base of the wad structure. Therefore, if desired, the payload cup can include a metal or stiff paper liner to resist the deformation, or the payload cup bottom can be a thicker plastic material as compared to the sidewalls.

There are countless variations and combinations of the structures of the disclosed shotshell components, and this disclosure anticipates that any combination or feature of one component can be selected for use with any other particular feature in another component.

While not limiting, the payload delivery system of this disclosure is especially advantageous for loading shotshells with steel shot. Conventional steel plastic wads are typically much thicker and harder plastic that lead shot wads, a feature that requires larger propellant charges or longer burning propellant to make up for their poor gas sealing qualities. Such loads are inefficient in their burning of propellants and may result in greater felt recoil. More recent steel wads have relied on complex slits, petals, cut outs, flaps, and airbrakes of various shapes for stability in flight, which greatly increases the required tooling costs and overall manufacturing costs. Such complex and hard structures may encounter problems with certain shotgun chokes and do not always result in stable flight.

In contrast, the present payload delivery system can be used with steel shot without the need for the complex slits, cut outs, or airbrakes, because the stability and flight characteristics are influenced by the simple, inexpensive pleated cups disclosed here. Thus, whether the pleated cup is used with a payload cup or whether it is used without a separate payload cup and instead constitutes a pleated payload cup itself, the cost to tool up and make such structures and the resulting overall cost are lower. For example, the pleated cup can be used with a payload cup, especially when longer range delivery of the payload is desired. A pleated payload cup, which is simply a pleated cup used without a separate payload cup, can be used when shorter range applications may be desired, such as delivering a powder in confined quarters. In these shorter range applications, wadless loadings with the pleated cup may be particularly useful. In either case, the ease of manufacturing and lower cost make these useful for many cartridge delivery systems, not merely for shotshells. Moreover, superior patterns can result for longer range delivery of a projectiles, because the rapid and consistent opening of the pleated shot cup provides high drag in a symmetrical fashion, which releases the projectiles cleanly for excellent ballistic performance.

DEFINITIONS

To define more clearly the terms used herein, the following definitions are provided, which are applicable to this disclosure unless otherwise indicated by the disclosure or the context. To the extent that any definition or usage provided by any document incorporated herein by reference conflicts with the definition or usage provided herein, the definition or usage provided herein controls.

The terms "payload delivery system", "payload delivery system", and "cartridge payload delivery system" are used interchangeably in this disclosure. Unless stated otherwise or unless the context requires otherwise, the use of any of these terms does not specify any particular type of projectile or payload intended to be launched from the cartridge that includes the components. Moreover, any combination of components that includes a pleated component can be considered to constitute a payload delivery system according to this disclosure, as the context allows or requires.

As used herein, a wad or cartridge wad according to this disclosure refers to the payload delivery system that combines a pleated cup with any type of cup, container, receptacle or holder for at least one projectile, whether shot, a slug projectile, or any type of payload to be launched by the cartridge. The term wad is often used in describing a shotshell, but by no means is the use of this term or this entire disclosure so limited. To the contrary, it is understood that this disclosure and the appended claims are not limited to shotshells, because the disclosed structures, components, and methods have a wide utility and are adaptable to any number of payload delivery systems, for example, those applicable to launching chemical, pyrotechnic, signaling, non-lethal, and other complex payloads in their respective cartridges.

As the context allows, the term "cartridge" can refer to the finished manufactured article, such as a completed ammunition cartridge. However, in some contexts, the term "cartridge" may refer to the empty cartridge "case", "hull", or "casing", having an inner wall defining a cavity that is charged according to this disclosure to provide the finished article, as apparent from its particular use.

Reference to the forward end or fore end of a particular component or cartridge means the end that is further downrange when the component or cartridge is in its intended orientation for firing. The fore end may also be termed the leading end or leading edge, the top, the downrange end, the distal end, or the crimp end, and these terms are used interchangeably.

Reference to the rearward or rear end of a particular component or cartridge means the end that is further uprange when the component or cartridge is in its intended orientation for firing. The rear end may also be termed trailing end or trailing edge, the aft portion or aft end, the bottom, the uprange end, the proximal end, the primer end, or the brass end, and these terms are used interchangeably.

A pleated cup, cup with pleated side wall, and similar terms are used in this disclosure to refer to the element of the payload delivery system that contains a pleated structure, regardless of whether that element is used with or without a payload cup component. When the pleated cup is attached to a payload cup or to the payload itself such as a solid projectile, the pleated cup may also be termed a stabilizing component, a pleated stabilizing component, a stabilizer, a pleated stabilizer, and the like, emphasizing its function to stabilize and slow the overall payload delivery system comprising the payload cup and pleated cup. The pleated cup can have the structure of a cup which receives, for example, a payload cup which could include a shot cup. However, the function of the pleated cup also could be achieved by the structure of a pleated skirt that attaches to the circumference of, for example, a payload cup such as a shot cup.

Reference to an obturating component or obturating member can include any component, whether pre-formed or not, that can provide a seal against expanding propellant gases, and can comprise, can consist of, or can be a pre-formed gas seal or an obturating medium. Unless the context requires otherwise or unless otherwise provided, the term gas seal also can refer to either a pre-formed gas seal or an obturating medium. Moreover, when describing a gas seal as a pre-formed gas seal includes the a separate component or a component integrated into a more complex payload delivery system, as the context requires.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes multiple particles of a chemical composition or mixture of compositions that constitutes a projectile, and the like.

Throughout the specification and claims, the word "comprise" and variations of the word, such as "comprising" and "comprises," means "including but not limited to," and is not intended to exclude, for example, other additives, components, elements, or steps. While compositions and methods are described in terms of "comprising" various components or steps, the compositions and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Unless indicated otherwise, when a range of any type is disclosed or claimed, for example a range of the particle sizes, percentages, temperatures, and the like, it is intended to disclose or claim individually each possible number that such a range could reasonably encompass, including any sub-ranges or combinations of sub-ranges encompassed therein. When describing a range of measurements such as sizes or weight percentages, every possible number that such a range could reasonably encompass can, for example, refer to values within the range with one significant figure more than is present in the end points of a range, or refer to values within the range with the same number of significant figures as the end point with the most significant figures, as the context indicates or permits. For example, when describing a range of percentages such as from 85% to 95%, it is understood that this disclosure is intended to encompass each of 85%, 86%, 87%, 88%, 89%, 90%, 91%, 92%, 93%, 94%, and 95%, as well as any ranges, sub-ranges, and combinations of sub-ranges encompassed therein. Applicants' intent is that these two methods of describing the range are interchangeable. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed herein, and that each value is also herein disclosed as "about" that particular value in addition to the value itself.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

What is claimed is:

1. A payload delivery system comprising, in its pre-launched configuration:

a) a payload cup having an open fore end, a closed aft end, and a cylindrical side wall defining a cavity;

b) a pleated cup coaxially aligned with the payload cup, having an open fore end, a closed aft end, and a pleated side wall defining a cavity that terminates at an edge contiguous with the pleated cup open fore end, wherein the pleats of the pleated side wall extend substantially longitudinally; and wherein the payload cup is nested within the pleated cup, such that the payload cup aft end is adjacent and attached to the pleated cup aft end and the payload cup sidewall is in contact with the pleated cup sidewall.

2. A payload delivery system according to claim 1, further comprising:

c) an obturating component adjacent the aft end of the pleated cup, comprising a pre-formed gas seal or an obturating medium.

3. A payload delivery system according to claim 1, further comprising:

c) an obturating medium adjacent the aft end of the pleated cup.

4. A payload delivery system according to claim 1, further comprising:

c) a pre-formed gas seal adjacent the aft end of the pleated cup and coaxially aligned with the payload cup and the pleated cup; and d) a connector that unites the pre-formed gas seal with the payload cup and the pleated cup.

5. A payload delivery system according to claim 1, wherein the pleated cup comprises paper, polymer, polymer coated paper, composite, laminate, or textile.

6. A payload delivery system according to claim 1, wherein the pleated side wall comprises knife plates, box pleats, accordion pleats, cartridge pleats, fluted pleats, Fortuny pleats, honeycomb pleats, organ pleats, pinch pleats, Plissé pleats, rolled pleats, Watteau pleats, or a combination thereof.

7. A payload delivery system according to claim 1, wherein the pleated side wall of the pleated cup is solid or perforated.

8. A payload delivery system according to claim 1, wherein the pleated side wall of the pleated cup extends greater than 50% the length of the cylindrical side wall of the payload cup.

9. A payload delivery system according to claim 1, wherein the aft end portion of the payload cup is recessed in an annular fashion from the fore end portion, wherein the aft end portion has a smaller diameter than the fore end portion, and the pleated side wall of the pleated cup extends the length of the recessed aft end portion of the payload cup.

10. A payload delivery system according to claim 1, wherein the closed aft end of the payload cup is crimped.

11. A payload delivery system according to claim 1, wherein the payload cup and the pleated cup are attached with a connector.

12. A payload delivery system according to claim 11, wherein the connector is selected from a rivet, a screw, a staple, a pin, a bolt, a brad, an anchor, an adhesive, a tack, or a nail.

13. A payload delivery system according to claim 11, wherein the connector comprises an integral pre-formed gas seal.

14. A cartridge comprising a payload delivery system according to claim 1, wherein the cartridge is an ammunition cartridge, a flare cartridge, a smoke flare cartridge, a signaling device cartridge, a chemical cartridge, a distraction device cartridge, a pyrotechnic launching device cartridge, a marking cartridge, a grenade launcher cartridge, an incendiary cartridge, an explosive cartridge, a tracer cartridge, an armor-piercing cartridge, or a non-lethal cartridge.

15. A cartridge comprising a payload delivery system according to claim 1, further comprising at least one of a frangible projectile, a non-frangible projectile, a lead projectile, a non-lead metal projectile, a steel projectile, a rubber projectile, a bean bag projectile, a tear gas-containing projectile, an oleoresin capsicum-containing projectile, a liquid-containing projectile, a powder-containing projectile, a gel-containing projectile, a marking projectile, a tracer projectile, a penetrator projectile, a flechette projectile, an armor-piercing projectile, an explosive projectile, an incendiary projectile, a flare projectile, or any combination thereof.

16. A cartridge comprising a payload delivery system according to claim 1 and at least one projectile selected from birdshot, buckshot, and slug projectiles.

17. A cartridge comprising a payload delivery system according to claim 1, further comprising at least one additional wad.

18. A cartridge comprising:

a) a cartridge case having a fore end and an aft end and, comprising a primer situated at the aft end;

b) a propellant adjacent the primer;

c) an obturating component adjacent the propellant;

d) a payload delivery system according to claim 1 adjacent the obturating component, and e) a payload at least partially contained within the cavity of the payload cup.

19. A cartridge according to claim 18, wherein obturating component comprises a pre-formed gas seal or an obturating medium.

* * * * *

UNITED STATES PATENT AND TRADEMARK OFFICE

CERTIFICATE OF CORRECTION

PATENT NO. : 9,182,202 B2
APPLICATION NO. : 13/599818
DATED : November 10, 2015
INVENTOR(S) : Menefee, III It is certified that error appears in the above-identified patent and that said Letters Patent is hereby corrected as shown below:

The Title page, showing the illustrative figures, should be deleted and substitute therefor the attached Title page.

In the drawings,

Sheet 1, Fig. 1 should be replaced with the attached drawing sheet.
Sheet 2, Fig. 2 should be replaced with the attached drawing sheet.
Sheet 3, Fig. 3 should be replaced with the attached drawing sheet.
Sheet 4, Fig. 4 should be replaced with the attached drawing sheet.
Sheet 5, Fig. 5 should be replaced with the attached drawing sheet.
Sheet 6, Fig. 6 should be replaced with the attached drawing sheet.
Sheet 7, Fig. 7 should be replaced with the attached drawing sheet.
Sheet 8, Fig. 8 should be replaced with the attached drawing sheet.

Signed and Sealed this
Twenty-fourth Day of May, 2016

Michelle K. Lee

Michelle K. Lee
*Director of the United States Patent and Trademark Office*

(12) United States Patent
Menefee, III

(10) Patent No.: US 9,182,202 B2
(45) Date of Patent: Nov. 10, 2015

(54) PAYLOAD DELIVERY SYSTEM WITH PLEATED COMPONENT FOR CARTRIDGES

(76) Inventor: James Y. Menefee, III, Macon, GA (US)

( * ) Notice: Subject to any disclaimer, the term of this patent is extended or adjusted under 35 U.S.C. 154(b) by 0 days.

(21) Appl. No.: 13/599,818

(22) Filed: Aug. 30, 2012

(65) Prior Publication Data

US 2013/0055917 A1 Mar. 7, 2013

Related U.S. Application Data

(60) Provisional application No. 61/530,101, filed on Sep. 1, 2011.

(51) Int. Cl.

| | |
|---|---|
| ***F42B 7/08*** | (2006.01) |
| ***F42B 7/04*** | (2006.01) |
| ***F42B 7/10*** | (2006.01) |
| ***F42B 5/02*** | (2006.01) |
| ***F42B 5/145*** | (2006.01) |
| ***F42B 8/02*** | (2006.01) |
| ***F42B 14/00*** | (2006.01) |

(52) U.S. Cl.

CPC ... *F42B 7/08* (2013.01); *F42B 7/04* (2013.01); *F42B 7/10* (2013.01); *F42B 5/02* (2013.01); *F42B 5/145* (2013.01); *F42B 8/02* (2013.01); *F42B 14/00* (2013.01)

(58) Field of Classification Search

CPC ..... F42B 5/00; F42B 5/02; F42B 5/145; F42B 7/00; F42B 7/02; F42B 7/04; F42B 7/043; F42B 7/08; F42B 7/10; F42B 8/00; F42B 8/02; F42B 14/00

USPC ..... 102/448, 449, 450, 451, 453, 457, 460, 102/461, 452, 454, 455, 456, 520, 521, 522, 102/523

See application file for complete search history.

(56) References Cited

U.S. PATENT DOCUMENTS

| | | | | | |
|---|---|---|---|---|---|
| 1,297,216 | A | * | 3/1919 | Matteus | 102/449 |
| 2,125,224 | A | * | 7/1938 | Edwards | 102/449 |
| 2,953,990 | A | * | 9/1960 | Miller | 102/449 |
| 3,074,344 | A | | 1/1963 | Pierre | |
| 3,313,235 | A | * | 4/1967 | Middleton, Jr. | 102/449 |
| 4,295,426 | A | * | 10/1981 | Genco et al. | 102/451 |
| 4,733,613 | A | | 3/1988 | Bilsbury et al. | |
| 4,773,329 | A | * | 9/1988 | Bilsbury | 102/451 |
| 5,874,689 | A | * | 2/1999 | Alkhatib et al. | 102/453 |
| 7,415,929 | B1 | | 8/2008 | Faughn | |
| 8,555,785 | B2 | * | 10/2013 | Cross | 102/451 |
| 2005/0039627 | A1 | * | 2/2005 | Zanoletti | 102/449 |

FOREIGN PATENT DOCUMENTS

| | | | |
|---|---|---|---|
| FR | 1548296 | A | 12/1958 |
| FR | 1180220 | A | 6/1959 |

OTHER PUBLICATIONS

International Search Report and Written Opinion for PCT/US2012/053060 mailed Nov. 23, 2012.

* cited by examiner

*Primary Examiner* James S Bergin

(74) *Attorney, Agent, or Firm* — Sutherland Asbill & Brennan LLP

(57) ABSTRACT

This disclosure provides for payload delivery systems and cartridges and methods that incorporate these payload delivery systems. In one aspect, the payload delivery system can comprise a payload cup and a pleated cup nested within the payload cup and having a pleated side wall. The disclosed cartridges can be used to deliver payloads such as solid projectiles, shot of all sizes, powders, gels, liquids, and other payloads to exploit their specific function.

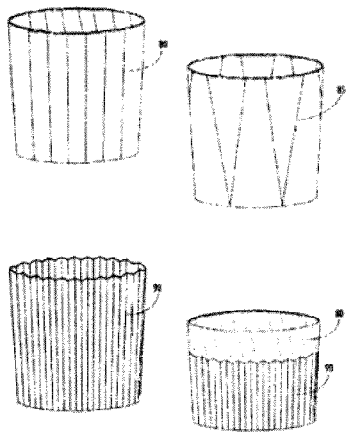

19 Claims, 8 Drawing Sheets